US006662717B2

(12) United States Patent
Kubota et al.

(10) Patent No.: US 6,662,717 B2
(45) Date of Patent: Dec. 16, 2003

(54) PRINTING CONTROL APPARATUS HAVING PRINTING ORDER INFORMATION PRODUCING FUNCTION

(75) Inventors: Nobuko Kubota, Ibaraki-ken (JP); Michael Mehigan, Ibaraki-ken (JP); Musashi Hirata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 225 days.

(21) Appl. No.: 09/946,634

(22) Filed: Sep. 6, 2001

(65) Prior Publication Data

US 2002/0029703 A1 Mar. 14, 2002

(30) Foreign Application Priority Data

Sep. 12, 2000 (JP) ..... P2000-277171

(51) Int. Cl.[7] ..... B41L 13/04

(52) U.S. Cl. ..... 101/116; 101/115; 101/114; 101/127; 101/48

(58) Field of Search ..... 101/116, 115, 101/114, 117, 118, 119, 48, 49, 127

(56) References Cited

U.S. PATENT DOCUMENTS 6,371,016 B2 * 4/2002 Takasawa et al. ..... 101/129

FOREIGN PATENT DOCUMENTS

| | | | | |
|---|---|---|---|---|
| JP | 03032556 A | * | 2/1991 | ..... B23Q/41/08 |
| JP | 03256657 A | * | 11/1991 | ..... B23Q/41/08 |
| JP | 05-229105 | | 9/1993 | |
| JP | 05-305555 | | 11/1993 | |
| JP | 11-208085 | | 8/1999 | |

* cited by examiner

*Primary Examiner*—Andrew H. Hirshfeld
*Assistant Examiner*—Minh Chau
(74) *Attorney, Agent, or Firm*—Gary M. Nath; Harold L. Novick; Marvin C. Berkowitz

(57) ABSTRACT

A printing control apparatus for controlling a stencil printing machine (50, 100), wherein a stencil sheet, which is made on the basis of image data, is wound around a printing drum (25; 125, 126) with which a print sheet (34; 141) is held in pressured contact to perform a stencil printing operation, provides the stencil printing machine with image data representative of an image to be reproduced as an object, and printing order information representative of a page order in which the printing operation is performed using image data, an ink color for the printing drum to be used, and a timing in which one printing drum is replaced with another one. In accordance with the printing order information, the ink color contained in image data is detected and an order for each page to be printed is determined on the basis of a user's print request to execute the printing operation according to the page order and to reduce the number of times the printing drum is replaced with.

22 Claims, 20 Drawing Sheets

FIG.3

TABLE 62

| | BLACK | BLUE | RED |
|---|---|---|---|
| PAGE 1 | ○ | ○ | |
| PAGE 2 | ○ | ○ | ○ |
| PAGE 3 | ○ | | ○ |
| PAGE 4 | ○ | ○ | |

FIG.4

PRINTING ORDER INFORMATION TABLE 63

| SINGLE COLOR PRINTING | | | |
|---|---|---|---|
| | BLACK | BLUE | RED |
| PAGE 1 | ○ ① | ○ ② | |
| PAGE 2 | ○ ④ | ○ ③ | ○ ⑤ |
| PAGE 3 | ○ ⑦ | | ○ ⑥ |
| PAGE 4 | ○ ⑧ | ○ ⑨ | |

(FIG.7 CONTINUED)
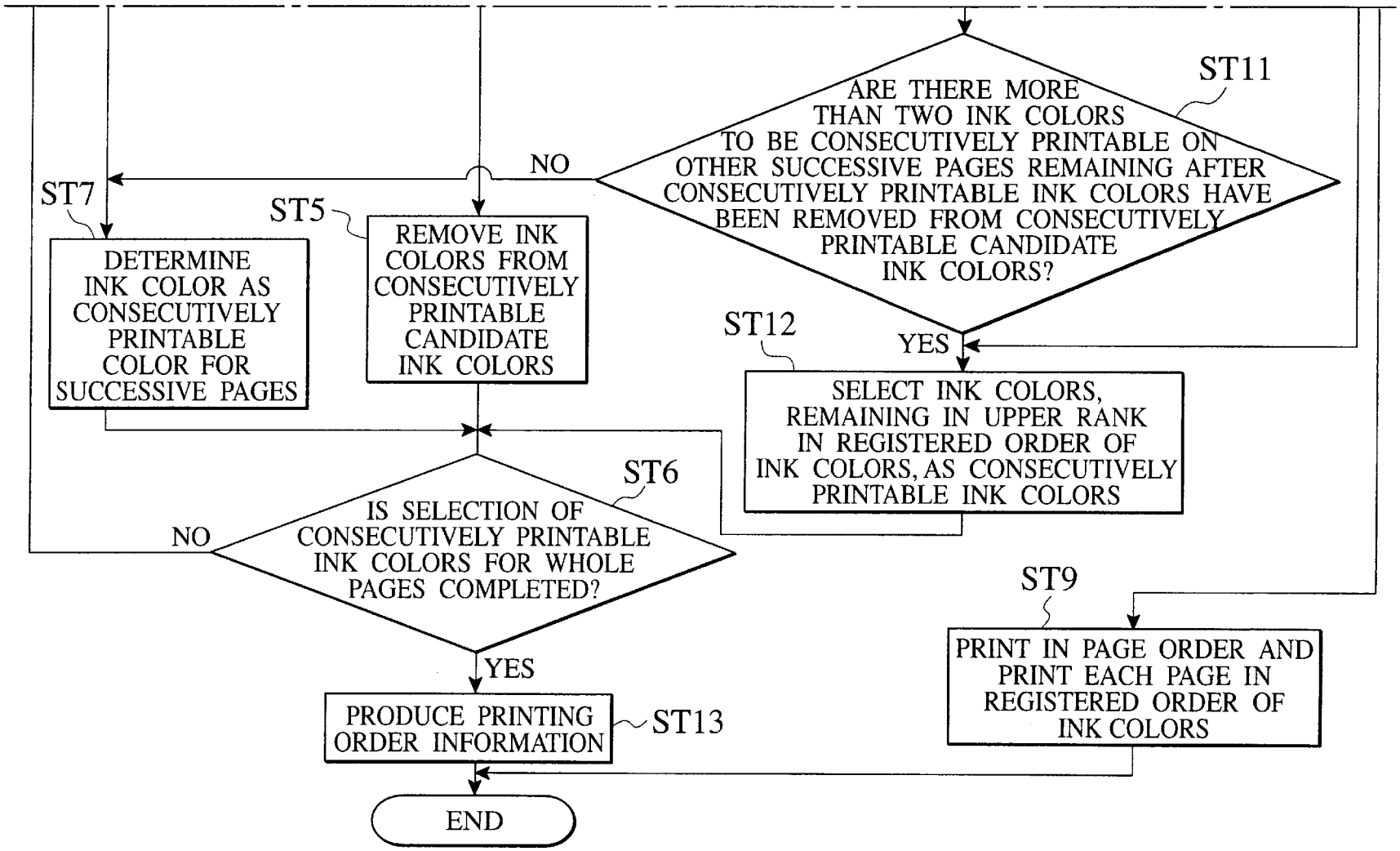

FIG.8

PRINTING ORDER TABLE 90

| SINGLE COLOR PRINTING | | | |
|---|---|---|---|
| | BLACK | BLUE | RED |
| PAGE 1 | ○ ① | ○ ⑤ | |
| PAGE 2 | ○ ② | ○ ⑥ | ○ ⑧ |
| PAGE 3 | ○ ③ | | ○ ⑨ |
| PAGE 4 | ○ ④ | ○ ⑦ | |

FIG.12

PRINTING ORDER TABLE 190

| TWO-COLOR PRINTING | | | |
|---|---|---|---|
| | BLACK | BLUE | RED |
| PAGE 1 | ○ ①-1 | ○ ①-2 | |
| PAGE 2 | ○ ②-1 | ○ ②-2 | ○ ⑤-2 |
| PAGE 3 | ○ ③-1 | | ○ ③-2 |
| PAGE 4 | ○ ④-1 | ○ ④-2 | |

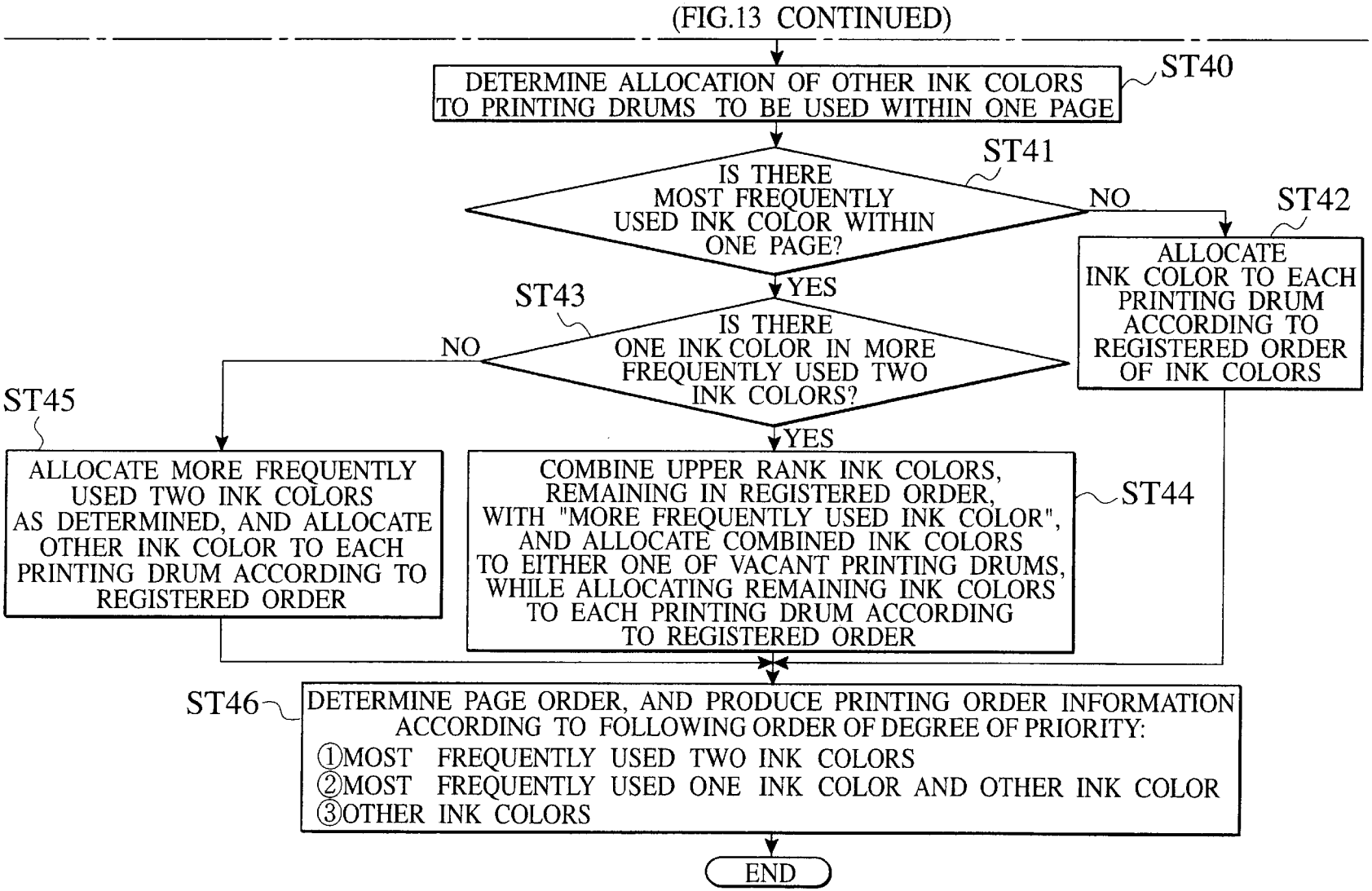
(FIG.13 CONTINUED)
ST40
DETERMINE ALLOCATION OF OTHER INK COLORS TO PRINTING DRUMS TO BE USED WITHIN ONE PAGE
ST41
IS THERE MOST FREQUENTLY USED INK COLOR WITHIN ONE PAGE?
NO
YES
ST42
ALLOCATE INK COLOR TO EACH PRINTING DRUM ACCORDING TO REGISTERED ORDER OF INK COLORS
ST43
IS THERE ONE INK COLOR IN MORE FREQUENTLY USED TWO INK COLORS?
NO
YES
ST44
COMBINE UPPER RANK INK COLORS, REMAINING IN REGISTERED ORDER, WITH "MORE FREQUENTLY USED INK COLOR", AND ALLOCATE COMBINED INK COLORS TO EITHER ONE OF VACANT PRINTING DRUMS, WHILE ALLOCATING REMAINING INK COLORS TO EACH PRINTING DRUM ACCORDING TO REGISTERED ORDER
ST45
ALLOCATE MORE FREQUENTLY USED TWO INK COLORS AS DETERMINED, AND ALLOCATE OTHER INK COLOR TO EACH PRINTING DRUM ACCORDING TO REGISTERED ORDER
ST46
DETERMINE PAGE ORDER, AND PRODUCE PRINTING ORDER INFORMATION ACCORDING TO FOLLOWING ORDER OF DEGREE OF PRIORITY:
①MOST FREQUENTLY USED TWO INK COLORS
②MOST FREQUENTLY USED ONE INK COLOR AND OTHER INK COLOR
③OTHER INK COLORS
END

FIG.14

PRINTING ORDER INFORMATION TABLE 192

| TWO-COLOR PRINTING | | | |
|---|---|---|---|
| | BLACK | BLUE | RED |
| PAGE 1 | ○ ①-1 | ○ ①-2 | |
| PAGE 2 | ○ ②-1 | ○ ②-2 | ○ ③-2 |
| PAGE 3 | ○ ④-1 | | ○ ④-2 |
| PAGE 4 | ○ ⑤-1 | ○ ⑤-2 | |

FIG.16

PRINTING SCHEDULE TABLE 196

FILE'S TITLE : ○○○

OWNER'S NAME :

| PRINTING ORDER | PAGE | DRUM ① | DRUM ② |
|---|---|---|---|
| 1 | PAGE 1 WHITE, LONGITUDINAL | BLACK ● | BLUE ◎ |
| 2 | PAGE 2 WHITE, LONGITUDINAL | BLACK ● | BLUE ◎ |
| 3 | PAGE 4 WHITE, LONGITUDINAL | BLACK ● | BLUE ◎ |
| 4 | PAGE 3 YELLOW, LONGITUDINAL | BLACK ● | RED ○ |
| 5 | PAGE 2 YELLOW, LONGITUDINAL | | RED ○ |

201 202 203 204 205 206 207

(FIG.17 CONTINUED)
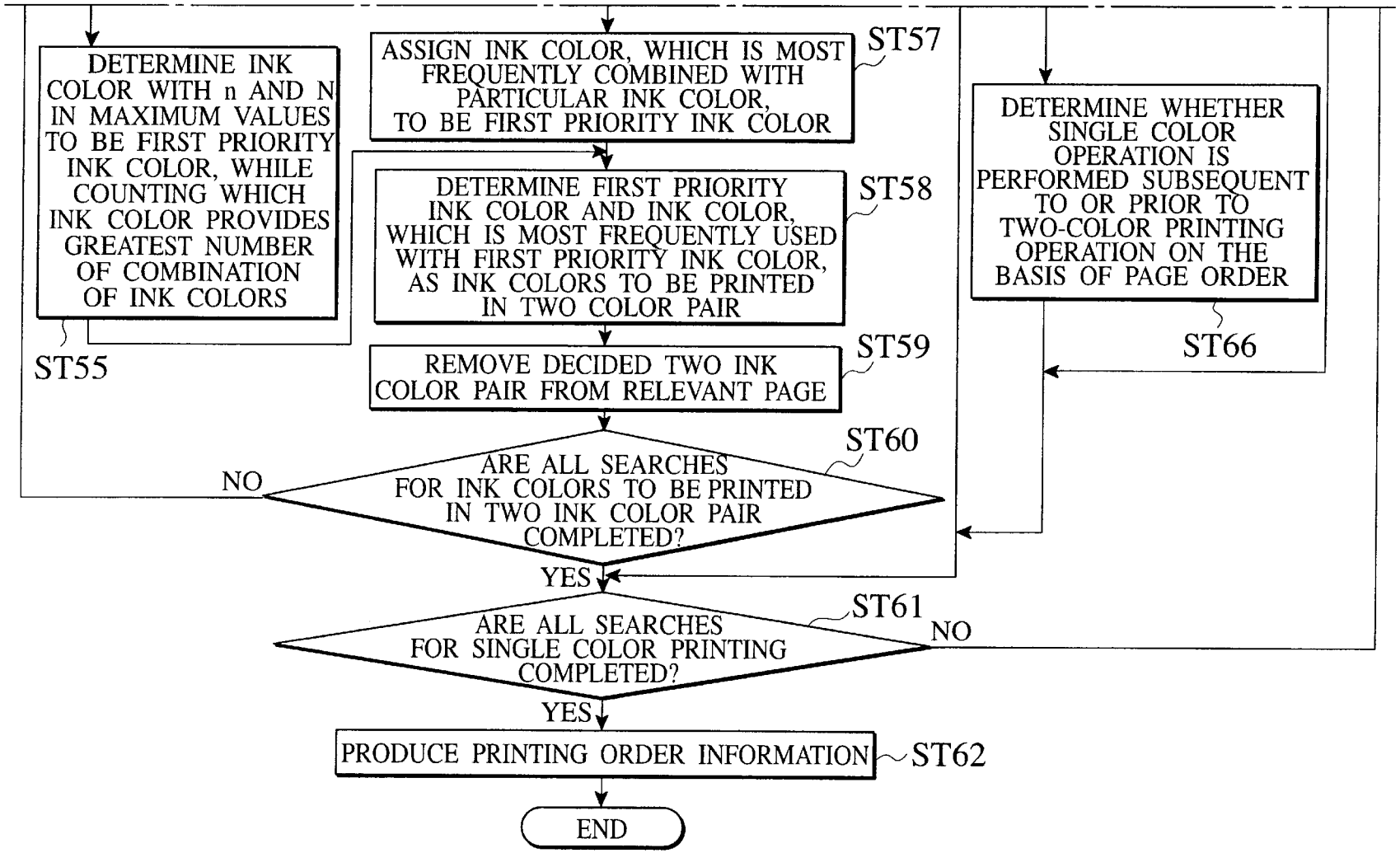

FIG.18

PRINTING ORDER INFORMATION TABLE 198

| TWO-COLOR PRINTING | | | |
|---|---|---|---|
| | BLACK | BLUE | RED |
| PAGE 1 | ○ ①-1 | ○ ①-2 | |
| PAGE 2 | ○ ②-1 | ○ ②-2 | ○ ⑤-2 |
| PAGE 3 | ○ ④-1 | | ○ ④-2 |
| PAGE 4 | ○ ③-1 | ○ ③-2 | |

PRINTING CONTROL APPARATUS HAVING PRINTING ORDER INFORMATION PRODUCING FUNCTION

BACKGROUND OF THE INVENTION

1. Field of the Invention

The present invention relates to a printing control apparatus for controlling a stencil printing machine wherein a plurality of stencil sheets, which are made on the basis of printing data, are wound around printing drums with which a print sheet is brought into pressured contact to perform a stencil printing operation.

2. Description of the Related Art

In the pasts, it has been a usual practice to use a stencil printing machine which enables a single color printing and a multi-color printing to be performed by allocating different ink colors to respective printing drums. Such a stencil printing machine is constructed of, for example, a first printing drum, a second printing drum and a press drum which are rotatably located, with the first and second printing drums being placed in the vicinity of an outer circumferential periphery of the press drum with a central angle of about 90 degrees with respect to the center of the press drum.

With such a stencil printing machine, printing data and printing start-up command are input from a PC (personal computer) connected through a communication network. In response to printing data and printing start-up command, the stencil printing machine makes a stencil sheet on the basis of printing data, with the stencil sheet being then wound on the printing drum with an associated ink color for thereby executing the printing operation. In this case, there have been many instances wherein when using different ink colors, the printing drum is replaced with a new one. When this takes place, in a printer driver, it has been a usual practice to provide a display over a display panel of the stencil printing machine or a display monitor with a warning display which calls user's attention to facilitate the printing operation to be executed with the different ink colors.

SUMMARY OF THE INVENTION

In order to control the multi-color printing operation with the PC wherein the printer driver is installed, conventionally, there have been many instances wherein printing data is transmitted to the stencil printing machine without any desired treatment. As a result, even in a case where the printing operation is implemented using the same ink color in consecutive pages, it was difficult to continuously execute the printing operation with color numbers used in each page. Further, since the printing operation is performed in a page order, there have been an increased number of times the printing drums are replaced for different ink colors, resulting in a degraded workability.

It is therefore an object of the present invention to provide a printing control apparatus which enables a printing operation at an increased operating efficiency to meet user's purposes in a multi-color printing operation, a recording medium which stores thereon a computer readable program, and a printing system.

According to a first aspect of the present invention, there is provided a printing control apparatus for controlling a stencil printing machine wherein a stencil sheet formed on the basis of printing data is wound around a replaceable printing drum with which a print sheet is held in pressured contact to implement a stencil printing operation, which comprises an information producing section configured to produce printing order information on the basis of image ink color information for each page contained in image data representative of an image to be reproduced in the stencil printing operation, in dependence on a page order, in which the stencil printing operation is executed, and the number of times the printing drum is replaced with, and an outputting section configured to output the image data and the printing order information to the stencil printing machine.

In accordance with the present invention, even when replacing the printing drum with a new one, printing order information is produced according to an image ink color to control the printing operation of the stencil printing machine.

According to a second aspect of the present invention, there is provided a computer-readable record medium having stored thereon a program for controlling a stencil printing machine wherein a stencil sheet is formed on the basis of image data and wound on an replaceable printing drum with which a print sheet is held in pressured contact to perform a stencil printing operation, which comprises an information producing section configured to produce printing order information on the basis of image ink color information for each page contained in image data representative of an image to be reproduced in the stencil printing operation, in dependence on a page order, in which the stencil printing operation is executed, and the number of times the printing drum is replaced with, and an outputting section configured to output the image data and the printing order information to the stencil printing machine.

In accordance with the present invention, the presence of a program read out into the computer allows the computer to functions as the aforementioned printing order information producing section and the aforementioned outputting section.

According to a third aspect of the present invention, there is provided a printing system which comprise a stencil printing machine wherein a stencil sheet is formed on the basis of image data and wound on a replaceable printing drum with which a print sheet is held in pressured contact to perform a stencil printing process, and a printing control apparatus including an information producing section configured to produce printing order information on the basis of image ink color information for each page contained in image data representative of an image to be reproduced in the stencil printing operation, in dependence on a page order, in which the stencil printing operation is executed, and the number of times the printing drum is replaced with, and an outputting section configured to output the image data and the printing order information to the stencil printing machine.

In accordance with the present invention, printing order information is produced on the basis of image ink-color information of each page contained in image data, which is then outputted to the stencil printing machine for controlling the printing operation of the stencil printing machine, thereby enabling the printing operation to be performed in a high operating efficiency to meet user's purposes in the multi-color printing operation.

BRIEF DESCRIPTION OF THE DRAWINGS

The invention, together with objects and advantages thereof, may best be understood by reference to the following description of the presently preferred embodiments together with the accompanying drawings in which:

FIG. 3 is a view for illustrating ink colors for each page to be used in a printing operation using image data;

FIG. 4 is a view for illustrating printing order information to be produced by a CPU when executing the printing operation in a page order with the stencil printing machine in the first preferred embodiment;

FIG. 8 is a view for illustrating a printing order table representative of printing order information to be produced in the CPU when executing the printing operation by reducing the number of times the printing drum is replaced in the stencil printing machine;

FIG. 12 is a view for illustrating printing order information to be produced by a CPU when executing the printing operation in a page order with the stencil printing machine in the second preferred embodiment;

FIG. 14 is a view for illustrating printing order information to be produced in the CPU when executing the printing operation by reducing the number of times the printing drum is replaced in the stencil printing machine, in the second preferred embodiment;

FIG. 16 is a view of a display panel of the stencil printing machine for displaying contents on the basis of printing order information;

FIG. 18 a view for illustrating printing order information to be produced in the CPU when executing the printing operation so as to reduce the number of times the printing drum is replaced in the stencil printing machine, in the second preferred embodiment.

DETAILED DESCRIPTION OF THE PREFERRED EMBODIMENTS

To describe the present invention more in detail, a preferred embodiment of the present invention will be described below in detail with reference to the drawings.

Figure 1:
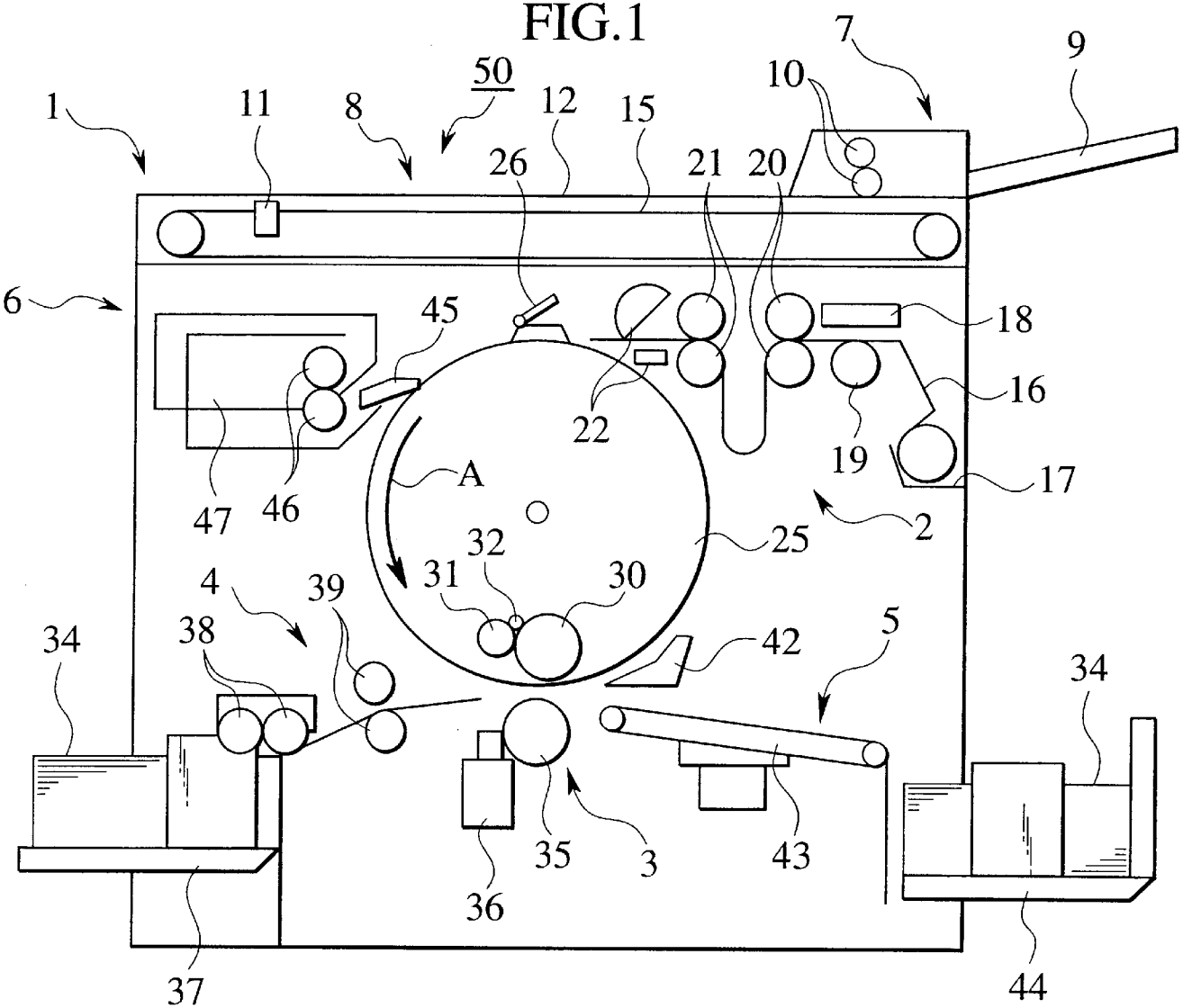
FIG. 1 is a schematic structural view of a stencil printing machine of a first preferred embodiment according to the present invention.

The present invention is applied to a stencil printing machine 50 which is, for example, constructed as shown in FIG. 1. The stencil printing machine 50 will be described below in detail with respect to a structure including, for example, cartridge type printing drums which are enabled to be exchanged by a user to permit a multi-color printing operation with ink in a large number of colors. Further, the present invention will be described with reference to a first preferred embodiment of a stencil printing machine which includes a single printing drum ad a second preferred embodiment of a stencil printing machine equipped with two printing drums.

First Preferred Embodiment

The stencil printing machine 50 of the first preferred embodiment is constructed in a manner as shown in FIG. 1. In FIG. 1, the stencil printing machine 50 is mainly constructed of an original read out section 1, a stencil making section 2, a printing section 3, a paper feed section 4, a sheet discharge section 5, and a stencil disposal section 6.

The original read out section 1 includes an automatic paper feed and read out unit 7 for obtaining image data by automatically feeding an original, and an original positioning and read out unit 8 for obtaining image data from the original which is positioned in place.

The automatic paper feed and read out unit 7 is constructed of an inclined original resting plate 9 to allow the original to be rested, an original feed roller pair 10 for transferring the original resting on the inclined original resting plate 9, and a line image sensor 11 for obtaining image data by converting contents of the original, which is transferred, to a train of electric signals. The line image sensor 11 is commonly used as that of the original positioning and read out unit 8.

The original positioning and read out unit 8 includes a horizontal original positioning glass table 12 for allowing the original to be positioned, a pressure plate (not shown) located on the horizontal original positioning glass table 12 for free opening and closing capabilities, a guide belt 15 located in an area below the horizontal original positioning glass plate 12 to be moveable with a drive force of a pulse motor (not shown), and the line image sensor 11 which is guided with the guide belt 15 to move in the area below the original positioning glass plate 12.

Further, the automatic paper feed and read out unit 7 has the line image sensor 11 to be located in a substantially upper right-hand corner of FIG. 1 and reads out the original, which is transferred with the original feed roller pair 10, with the line image sensor 11. In the original positioning and read out unit 8, the line image sensor 11 is guided and moved with the guide belt 15 to scan a lower surface of the original to read out the contents of the original.

The stencil making section 2 includes a stencil sheet receiving tray 17 which receives an elongated stencil sheet 16 in the form of a roll, a thermal printing head 18 composed of a writing head which is located at a position downstream of the stencil sheet receiving tray 17 in a transferring direction of the stencil sheet 6, a platen roller 19 located in opposed relation to the thermal printing head 18 and driven by a pulse motor (not shown), a stencil feed roller pair 20 located downstream of the thermal printing head 18 and the platen roller 19 in the transferring direction of the stencil sheet 16 and rotated with the drive force of the pulse motor (not shown), a stencil feed roller pair 21 located further downstream of the stencil feed roller pair 20 in the transfer direction of the stencil sheet, and a stencil cutter 22 located downstream of the stencil feed roller pair 21.

The thermal printing head 18 includes a plurality of dot-shaped thermal elements located, in a plane perpendicular to the transfer direction of the stencil sheet 16, to occupy a space in a range equal to a paper size of A3 to meet the maximum size A3 of a print sheet which is intended in the first preferred embodiment.

In addition, rotation of the platen roller 19 and the stencil feed roller pairs 20 and 21 allows the stencil sheet 16 to be transferred. During such transfer of the stencil sheet 16, the dot-shaped thermal elements of the thermal printing head 18 are selectively activated to produce heat on the basis of image data read out with the line image sensor 11 to permit thermal perforation in the stencil sheet 16 to form a desired perforated area, with a trailing edge of the stencil sheet 16, which has the desired perforated area, being cut with the stencil cutter 22 to form a perforated stencil sheet 16 of a given length.

The printing section 3 is constructed of a printing drum 25 including an outer peripheral portion composed of an ink permeable member formed in a perforated structure and rotated in a direction as shown by an arrow A in FIG. 1 with a drive force of a main motor (not shown), and a clamping base 26 mounted to the outer periphery of the printing drum 25 for clamping a leading edge of the stencil sheet 16.

Further, the printing section 3 includes a squeegee roller 30 and a doctor roller 31 located inside the printing drum 25, an ink supply unit (not shown) for supplying ink 32 to an area between the rollers 30, 31, a press roller 35 for urging a print sheet 34, which is transferred in synchronism with rotation of the printing drum 25, against the stencil sheet 16, and a plunger 36 which selectively moves the press roller 35 into a pressurized engagement position and a waiting position.

With such a structure, clamping the leading edge of the stencil sheet 16, which is transferred from the stencil making section 2, while permitting rotation of the printing drum 25 in the clamped state of the stencil sheet 16 allows the stencil sheet 16 to be wound around and mounted to the outer periphery of the printing drum 25. When this occurs, the print sheet 34, which is transferred in synchronism with the rotation of the printing drum 25, is brought into pressured contact with the stencil sheet 16 of the printing drum 25 with the action of the press roller 35, allowing the ink 32 to be transferred through a perforated area of the stencil sheet 16 onto the print sheet 34 to reproduce a desired image thereon.

The paper feed section 4 is constructed of a paper feed tray 37 on which a stack of the print sheets 34, which serve as printing media, is placed, a primary paper feed roller pair 38 for moving only one print sheet 34 from the uppermost position of the stack of the print sheets 34 in the paper feed tray 37, and a secondary paper feed roller pair 39 for transferring the print sheet 34, which is transferred with the paper feed roller pair 38, to an area between the printing drum 25 and the press roller 35 in synchronism with the rotation of the printing drum 25. The primary and secondary paper feed roller pairs 38, 39 are so arranged as to be selectively applied with the drive force of the main motor (not shown) by means of respective paper feed clutches (not shown).

The sheet discharge section 5 includes a sheet peeling claw 42, a belt-conveyer transfer mechanism 43 for transferring the print sheet 34 which is peeled off with the sheet peeling claw 42, and a paper receiving tray 44 for allowing the print sheet 34, which has been printed and is transferred with the belt-conveyer transfer mechanism 43, to be placed in a stacked state.

The stencil disposal section 6 includes a stencil separating claw 45 for peeling the stencil sheet 16 off from the printing drum 25, a stencil separating roller pair 46 for transferring the stencil sheet 16 peeled off with the stencil separating claw 45, and a stencil disposal box 47 for receiving the stencil sheet 16 which is transferred with the stencil separating roller pair 46.

Figure 2:
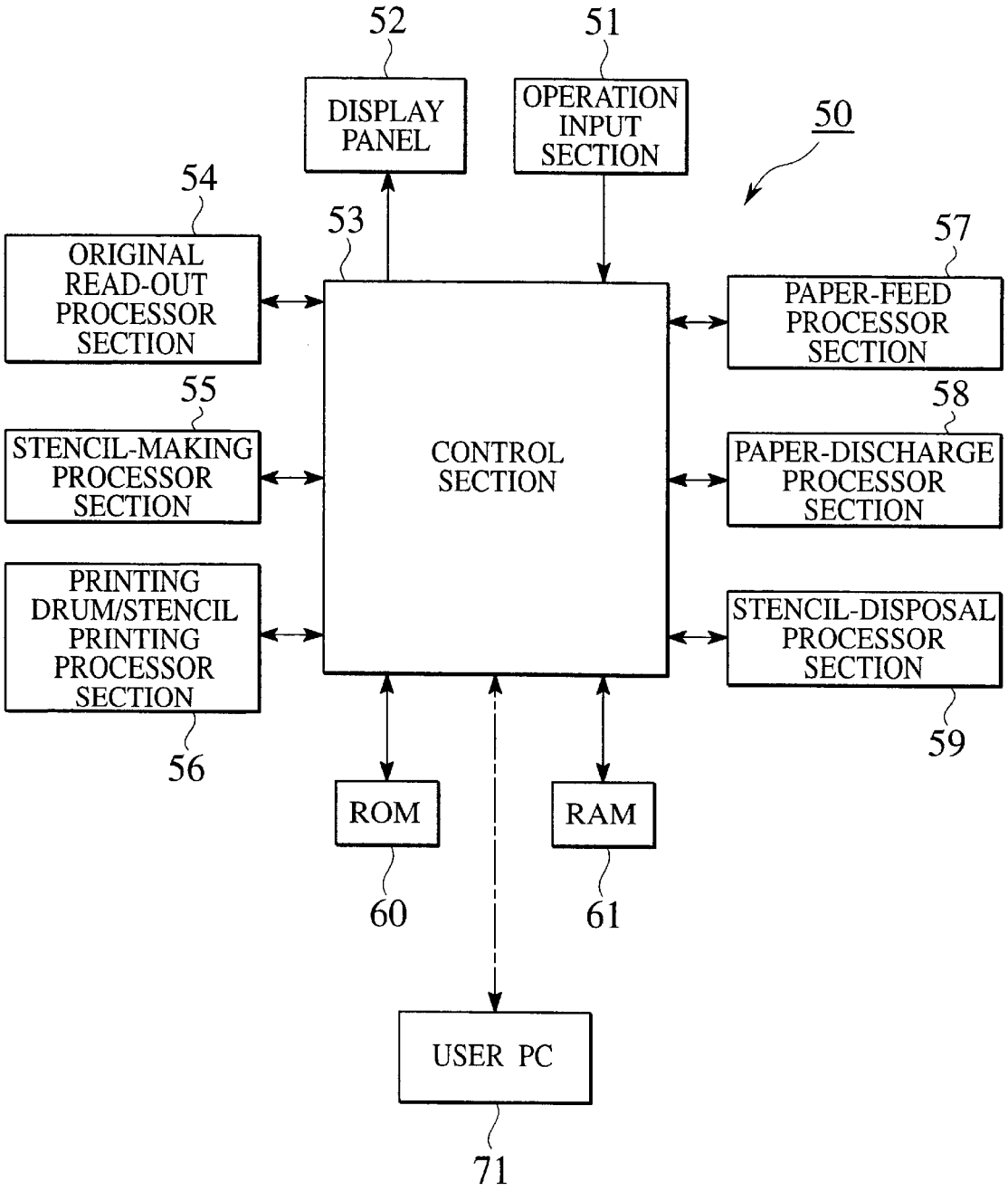
FIG. 2 is a block diagram of a control system for the stencil printing machine of the first preferred embodiment according to the present invention.

Now, a control system of the stencil printing machine 50 of the first preferred embodiment is described below in detail with reference to FIG. 2.

A body frame 50*a* of the stencil printing machine 50 of the first preferred embodiment is provided with an operation input section 51 and a display panel 52. The operation input section 51 includes a stencil-making/printing start-up key, ten keys for inputting various input data such as the number of the print sheets, and a single-color print key. The operation input section 51 produces various operation input information in response to user's various set-up operations and outputs these information to a control section 53.

Input data is outputted from the operation input section 51 to the control section 53, which responds to the input data and executes general control over an original read-out processor section 54, a stencil-making processor section (stencil making section) 55, a stencil-printing processor section (printing section) 56, a paper-feed processor section 57, a sheet discharge processor section 58, and a stencil-disposal processor section (stencil disposal section) 59. Also, the control section 53 executes control for writing-in or reading-out from a ROM 60, in which various control programs are stored, and a RAM 61.

Further, the control section 53 is interconnected with a personal computer 71 (which is hereinafter called as a user PC 71) via a communication network and is so arranged as to read out image data, which is an object to be printed, scheduled printing order information indicative of a printing order, and printer control commands.

The control section 53 responds to the printer control commands, which are produced by a printer driver installed in the user PC 71, for executing operational control, such as input of image data, start-up and stop control of stencil making operation, and start-up and stop control of printing operation.

The user PC 71 is constructed as including a display monitor for providing a display of various contents, an input-output interface for transferring and receiving data, commands and various other information to and from the control section 53 of the stencil printing machine 50 via a communication network, a memory unit which stores image data and printer control programs (i.e., a printer driver) for controlling the operation of the stencil printing machine 50, and a CPU (Central Processing Unit) which executes the start-up of the printer control programs in response to the user's operational inputs, transmission of data to the stencil printing machine 50, and transmission of the printer control commands.

Now, a process for producing scheduled printing order information using the CPU will be described below in detail.

In this example, the process for producing scheduled printing order information is described with reference to an instance wherein image data, which is the object to be printed, includes a first page involving a black ink color and a blue ink color, a second page involving the black ink color, the blue ink color and a red ink color, a third page involving the black ink color and the red ink color, and a fourth page involving the black ink color and the blue ink color, as shown by a table 62 in FIG. 3, and wherein the printing operation is carried out on the basis of such image data.

When printing image data, shown in FIG. 3, in a page order, the CPU produces scheduled order information representing that the printing operation is to be carried out in a sequence indicated in a printing order information table 63 shown in FIG. 4. Here, in an example shown in FIG. 4, the scheduled printing order is shown with respect to a case wherein the printing operation is performed to complete printing of the first to fourth pages using printing drums with the black, blue and red ink colors, with circled reference numerals representing scheduled printing order displays.

More particularly, the CPU produces scheduled printing order information for the first page to be printed with the printing drum in a black ink color followed with the printing drum in a blue ink color, for the second page to be printed with the printing drum in the blue ink color, which has been used in printing the first page, with the printing drum in the black ink color, and with the printing drum in a red ink color, all of which printing drums are sequentially replaced, for the third page to be printed with the printing drum in the red ink color, which has been previously used in printing the second page, and with the printing drum in the black ink color, both of which printing drums are sequentially replaced, and for the fourth page to be printed with the printing drum in the black ink color, which has been previously used in printing the third page, and with the printing drum in the blue ink color, which are sequentially replaced.

Figure 5:
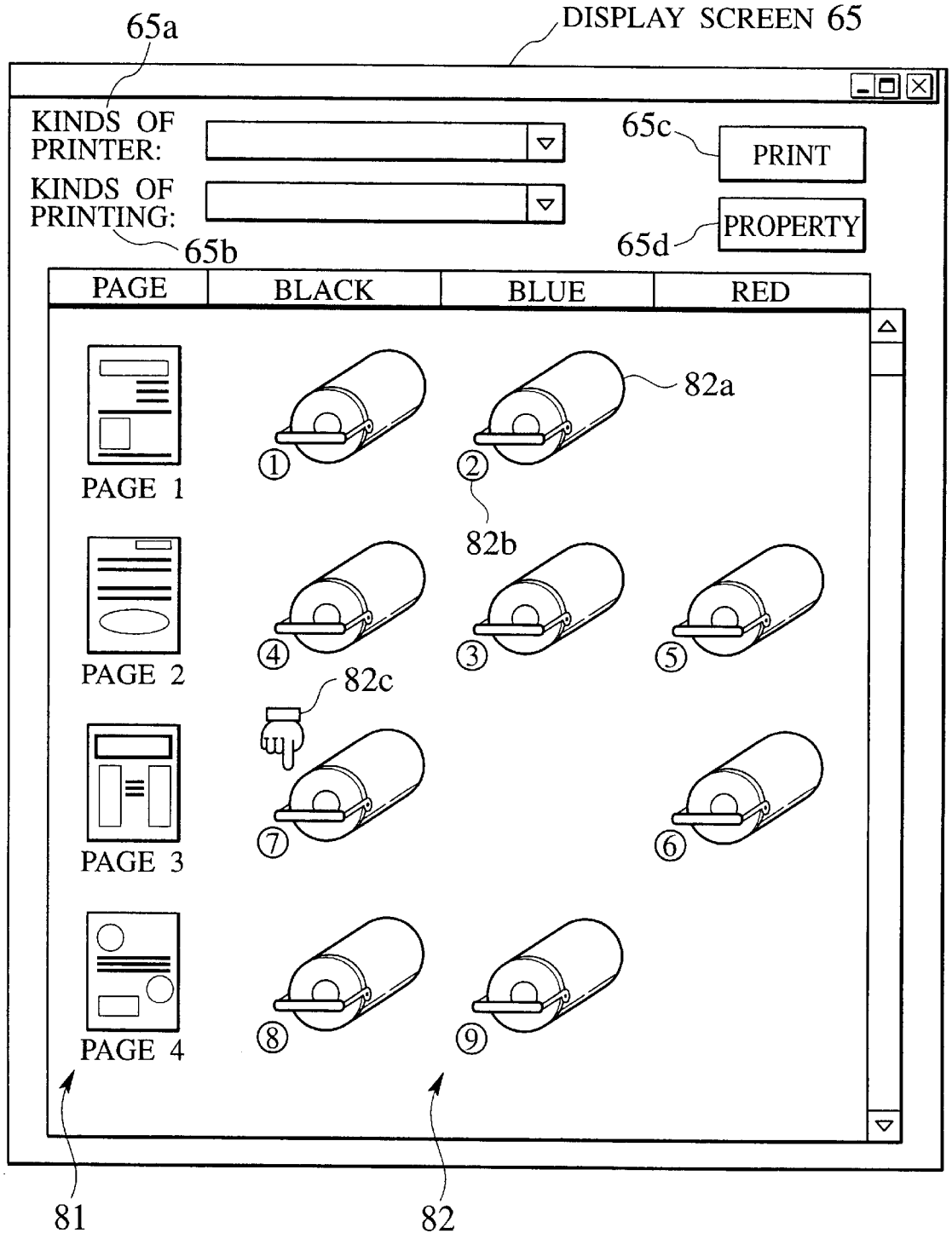
FIG. 5 is a view for illustrating a display screen of a display monitor of a user PC for displaying a page summary display and an ink drum display in accordance with printing order information in the first preferred embodiment.

Based on such scheduled printing order information, the CPU produces display data representing a display screen 65, as shown in FIG. 5, which will appear over the display monitor of the user PC 71. The display screen 65 has in an upper part a selection column 65*a* for selecting a suitable item from "kinds of Printer", a selection column 65*b* for selecting "Kinds of Printing", a "Print" key button 65*c* and a "Property" button 65*d*. As shown in FIG. 5, the CPU allows a page summary display 81, which represents a page summary, and an ink drum display 82, which represents ink drums to be employed for each page, to appear over the display monitor.

In accordance with scheduled printing order information, the CPU allows the page summary display 81 to appear on the display screen 65 for providing the user with a summary of the first to fourth pages as viewed in FIG. 5. The ink drum display 82 involves a plurality of picture pattern displays 82*a* representing respective printing drums 25 allocated with respective ink colors to be used in correlated relationship with the page summary display 81 contained in image data, a scheduled order display 82*b* for displaying a scheduled order in which a particular printing drum is used for printing, and a symbol mark display 82*c* representing the currently interacting printing drum 25 which is in charge for currently printing a particular page, i.e., for, example, a page 3 in FIG. 5.

Figure 6:
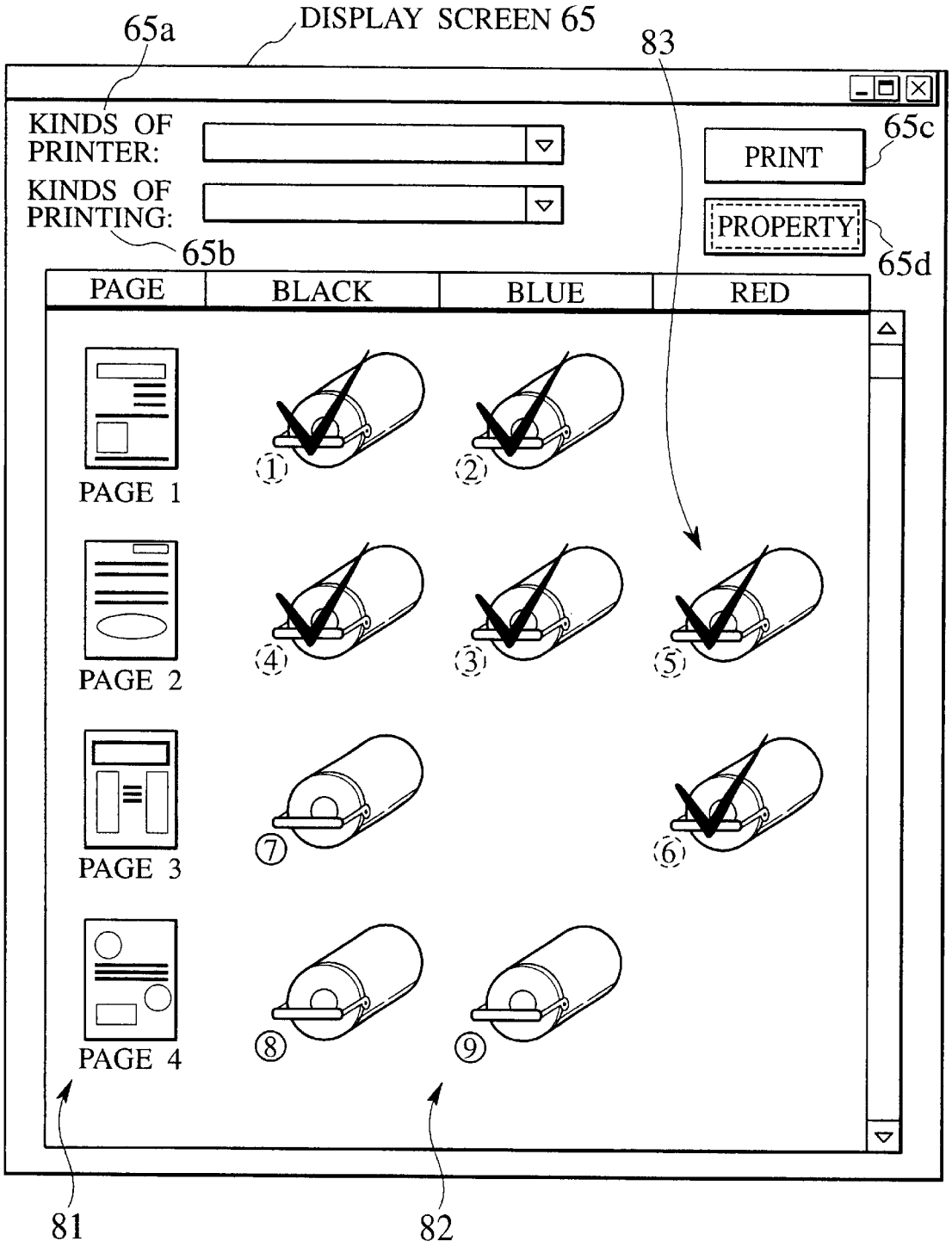
FIG. 6 is a view for illustrating a printing termination display added with a check mark, which represent that the printing step has been terminated during the printing operation carried by the stencil printing machine in the first preferred embodiment, and an order display given with a halftone.

The CPU responds to a signal, indicative of termination of the printing operation with the respective printing drums, outputted from the stencil printing machine 50, thereby displaying a printing termination display 83 with check marks being applied to the respective terminated printing drums 25 as viewed in FIG. 6, while giving highlights on the scheduled printing order displays related to the terminated printing drums 25. When it is needed to replace the printing drum 25 in the blue ink color with another one in the black ink color, the CPU allows the display monitor to provide a display of such requirement for the user.

Figure 7:
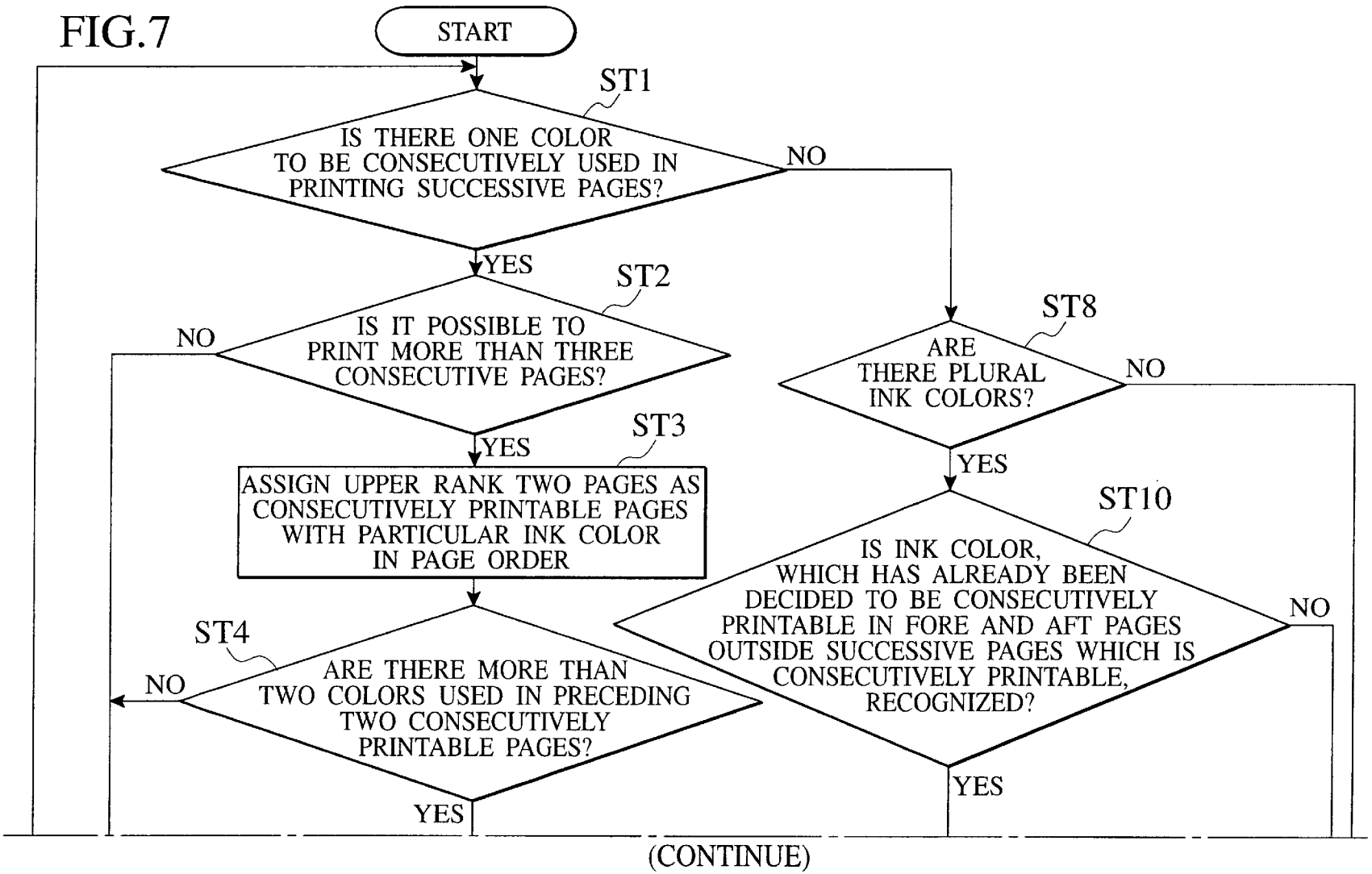
FIG. 7 is a general flow diagram for illustrating the basic sequence of a process to be carried out in the CPU when producing printing order information representing that the printing operation is implemented in a page order contained in image data.

The basic sequence of a process to be executed in the CPU for producing scheduled printing order information to enable printing in the page order contained in image data is described below in detail with reference to FIG. 7.

When the CPU produces image data, which is the object to be printed, and receives a command from the user to execute the printing operation in accordance with the page order, the CPU discriminates from image data whether there is one color to be consecutively printed on successive pages (Step ST1). In this instance, the CPU functions to perform a detecting process to detect the ink color contained in image data which constitutes two successive pages.

In the next step ST2, the CPU discriminates from image data whether it is possible to consecutively print over more than three pages with the same ink color detected in the step ST1. In this instance, the CPU performs a detecting process for detecting the ink color contained in image data which constitutes the next page subsequent to the last page detected in the step ST1. When it is found that it is possible to print over three successive pages with the printing drums 25 in the same ink color, the operation goes to step ST3, whereas when a difficulty is encountered, the operation goes to step ST7.

In the next step ST3, the CPU assigns upper rank two pages, among the pages whose ink colors are detected in steps ST1 and ST2, as consecutively printable pages, thereby adding consecutively printable information representing a capability of consecutively printing the aforementioned upper rank two pages.

In the next step ST4, the CPU discriminates whether more than two ink colors are used in a particular page subsequent to the upper rank two pages selected in the step ST3. When it is found that more than two ink colors are used in the particular page, the operation goes to step ST5 to remove those ink colors from candidate ink colors which can be consecutively used in printing, and the operation goes to step ST6.

On the contrary, if it is found that it is difficult to consecutively print over more than three pages in step ST2, the CPU determines a particular ink color to be consecutively used in printing over two pages in step ST7, adding consecutively printable information representing the capability of consecutively printing on those two pages, and the operation goes to step ST6.

Further, when it is discriminated that the ink color to be consecutively printable over the pages consists of one color, the CPU discriminates whether there are a plurality of ink colors to be consecutively printable in step ST8. In this instance, when there are not plural ink colors, i.e., when the plural ink colors to be consecutively printed are absent, the operation goes to step ST9, which will be discussed later, and when the plural ink colors are present, the operation goes to step ST10.

In the next step ST10, the CPU executes a judgment (step ST10) of whether to enable recognition of the ink color which has been already decided to be consecutively printable in fore and aft pages outside the successive pages which can be consecutively printable. When it is found to be recognized, the operation goes to step ST11, and when it is not found to be recognized, the operation goes to step ST12. In this instance, the CPU executes a judgment by detecting consecutively printable information added to each page.

In consecutive step ST11, the CPU removes those consecutively printable ink colors, which have been recognized in the step ST10, from the consecutively printable candidate ink colors, thereby executing judgment of whether there are more than two ink colors to be consecutively printable on other successive pages remaining after the particular ink colors have been removed, on the basis of consecutively printable information.

When it is judged that there are more than two ink colors which are consecutively printable, the operation goes to step ST12 to select the ink colors, which remain in the upper rank in a registered order of preset ink colors, as those which can be consecutively printed, and then the operation goes to step ST6. In contrast, when it is judged that there are not more than two ink colors to be consecutively printable, the CPU allows the operation to go to step ST7 to perform the aforementioned operations.

Here, the "registered order" refers to a scheduled order which is preliminarily designated by the user in accordance with, for example, the kinds (black, blue and red) of the ink colors.

In step ST6, the CPU executes judgment of whether the consecutively printable ink colors are selected in the executions of steps ST3, ST7 or ST12 for the whole pages contained in image data. When it is judged that the consecutively printable ink colors are selected for the whole pages, the operation goes to step ST 13. When, in contrast, it is judged that the consecutively printable ink colors are not selected for the whole pages, the operation returns to step ST1 to repeatedly execute the operations of the steps ST1 to ST12 again.

In step ST9 in a case wherein it is judged that there are not ink colors to be consecutively printable in step ST8, the CPU allows the successive pages to be printed in the page number order, while allowing the discrete page to be printed in the registered order of the ink colors.

In step ST13, the CPU produces scheduled printing order information on the basis of consecutively printable information indicative of the ink colors, which have been decided to be consecutively printable in the aforementioned operations, and information indicative of the registered order of the ink colors. That is, the CPU recognizes the ink color or the ink colors to be used in an initial printing step and/or a final printing step when printing each page in accordance with information indicative of the consecutively printable ink colors, thereby producing scheduled printing order information to enable printing in accordance with the registered order of the ink colors except the one which is initially used in each page.

In particular, in an example of a printing order table 90 shown in FIG. 4, the CPU recognizes an ink color, which is initially used for printing the second page, to be the blue color, and recognizes an ink color, which is finally used in printing the second page, to be the red color, in accordance with information indicative of the ink colors decided to be consecutively printable. With such recognition, the CPU makes it possible to produce scheduled printing order information to allow the same blue ink color to be used for printing the first and second pages and to allow the same red ink color to be used for printing the second and third pages.

With such scheduled printing order information, it is possible for the stencil printing machine 50 to execute the printing operation at a high efficiency to meet user's purpose during multi-color printing in dependence on the page order.

When printing the pages in a scheduled order to reduce the number of times the printing drum is replaced, the CPU produces scheduled printing order information to execute the printing operation in a sequence indicated, for example, in a printing order table 90 shown in FIG. 8. In particular, the CPU produces scheduled printing order information to firstly print first, second, third and fourth pages in order using the printing drum 25 in black ink color, followed to print the first, second and fourth pages in order using the printing drum 25 in blue ink color and finally to print the second and third pages in order using the printing drum in red ink color. With such scheduled printing order information to effectuate the printing operation in a scheduled order, the number of times the printing drum 25 is replaced is reduced to a smaller number of time, i.e., two times, than that required in the example shown in FIG. 4.

Figure 9:
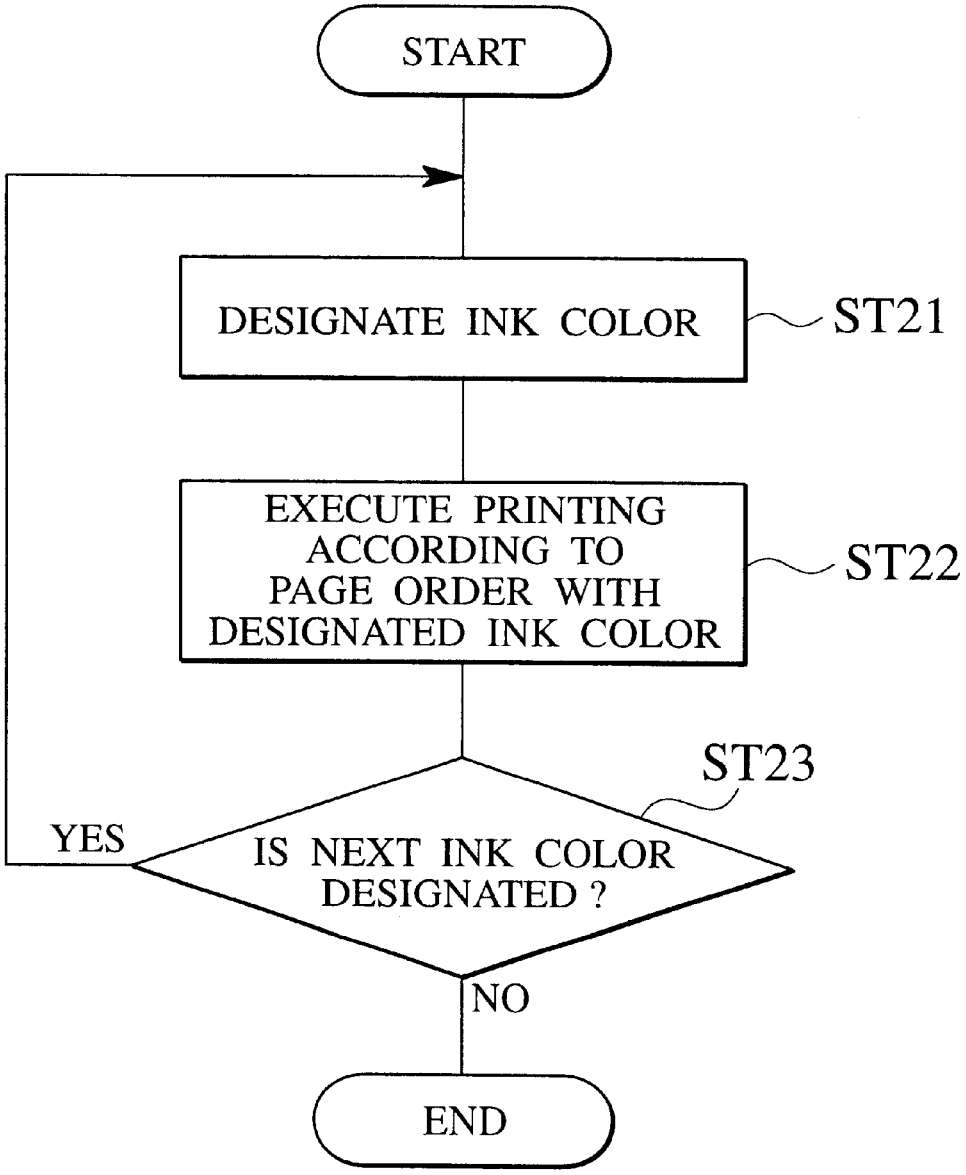
FIG. 9 is a general flow diagram for illustrating the basic sequence of a process to be carried out in the CPU when producing printing order information so as to reduce the number of times the printing drum is replaced.

Now, an attention is made to the basic sequence of operations to be carried in the CPU for producing scheduled printing order information to reduce the number of times the printing drum is replaced, in conjunction with FIG. 9.

The CPU produces image data to become an object to be printed and responds to user's command to initiate the printing operation according to the page order to commence the printing operation for each ink color in step ST21. That is, the CPU begins to print by designating the ink colors from the uppermost rank page to the lowermost rank page according to the registered order of the preset ink colors. Here, the "registered order of the ink colors" is meant by the fact that, in FIG. 8, the black color remains in the uppermost rank, and the blue and red colors are registered in order.

In the next step ST22, the CPU detects the ink color to be used for printing with the use of each image data, and allows the printing operation to be executed with the ink color, which is designated in step ST21, in accordance with the page order.

In the next step ST23, the CPU discriminates whether the ink color designated in step ST21 does not belong to the uppermost rank and whether to designate the subsequent ink color. When it is found that the ink color, which has been used in step ST22, does not in the uppermost rank, the operation of the CPU returns to step ST21 to designate the subsequent ink color to enable the printing operation in step ST22. When it is found that the ink color used in step ST22 belongs to the uppermost rank, then the CPU terminates the printing operation.

With such a processing function of the CPU, it is possible to reduce the number of times the printing drum 25 is replaced, thereby enabling the multi-color printing operation at a high efficiency in accordance with the user's demands.

In the aforementioned first preferred embodiment, although the present invention has been described with respect to the example wherein the various contents are arranged to be displayed over the display monitor of the user PC 71, the display panel 52 of the stencil printing machine 50 may be arranged to display the same contents as those displayed by the display monitor. With such arrangement, it is possible for the stencil printing machine 50 to instruct the user about timings for replacing the printing drums in different ink colors and progressive status of the printing operations, with a resultant highly improved readiness and maneuverability.

In the aforementioned first preferred embodiment, although the present invention has been described with respect to the example wherein the stencil printing machine 50 is applied with and is controlled by the printing command, to execute the printing operation according to the paper order, or the printing command, to execute the printing operation in reduced number of replacement times of the printing drums 25 which are transmitted from the user PC 71, the CPU may produce scheduled printing order information representative of a scheduled order in which the printing operation is started with the printing drum 25 of less density in the strength of the ink color with a priority being given to an image quality on the basis of other factors, i.e., by minimizing the number of re-transfer operations.

In the aforementioned example, further, although the present invention has been discussed with respect to the example wherein the CPU produces scheduled printing order information depending on the page order and scheduled printing order information which enables reduction in the number of times the printing drum is replaced, the CPU may produce scheduled printing order information with due regard to plural conditions. That is, the CPU may produce scheduled printing order information on the basis of the page order, while minimizing the number of the re-transfer operations.

In the aforementioned example, furthermore, although the present invention has been discussed with respect to the example of an automatic order mode wherein scheduled printing order information is automatically produced, in response to the printing commands, with the user PC 71 in accordance with the ink colors of image data, the user PC 71 may produce scheduled printing order information responsive to the user's operation for controlling the stencil printing machine 50 and may also automatically produce scheduled printing order information which can be altered by user's manual operation input in a manual order mode.

Second Preferred Embodiment

Figure 10:
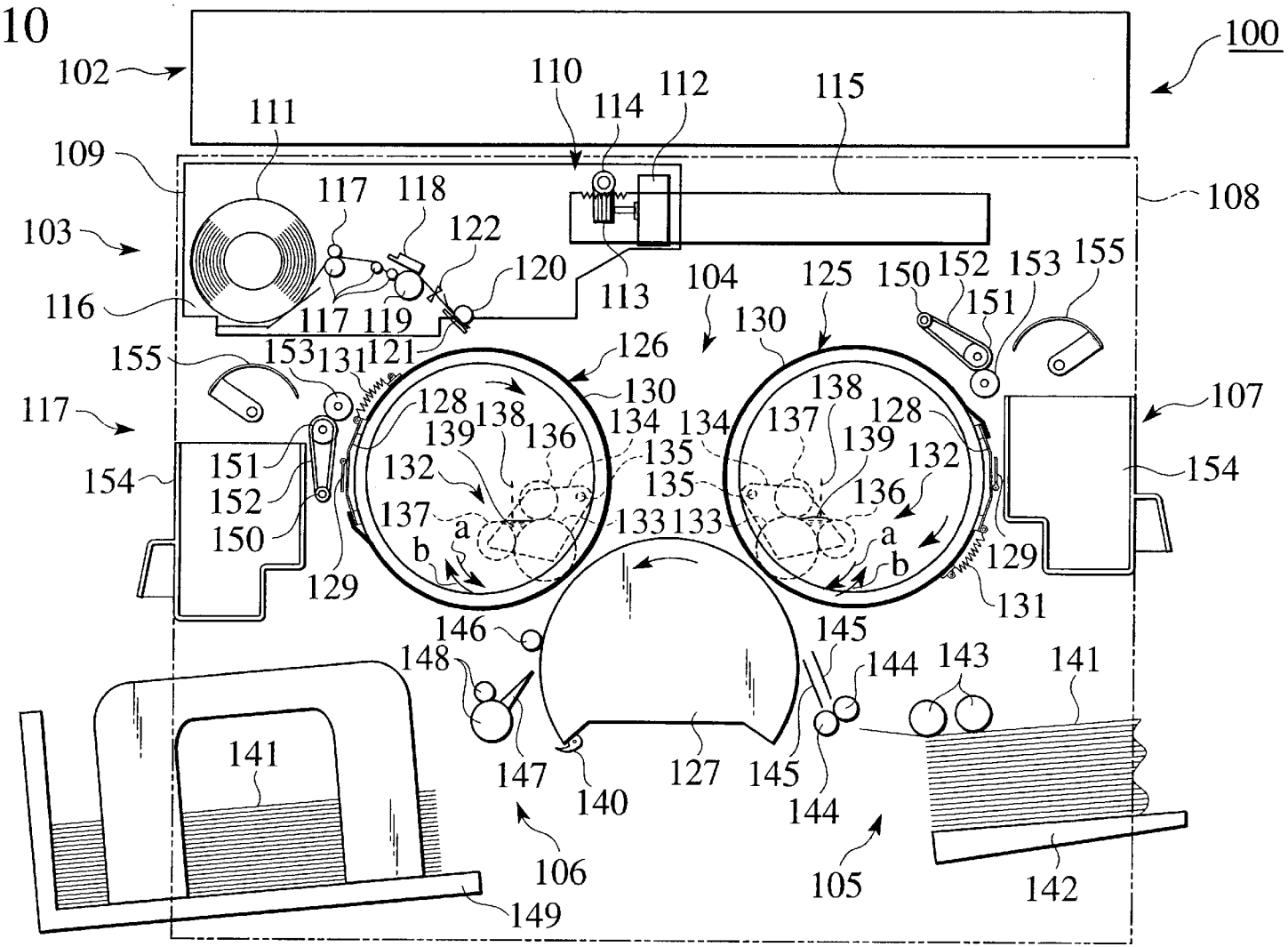
FIG. 10 is a schematic structural view of a stencil printing machine of a second preferred embodiment according to the present invention.

Now, a stencil printing machine of a second preferred embodiment will be described below in detail. As shown in FIG. 10, the stencil printing machine 100 of the second preferred embodiment is mainly constructed of an original read out section 102, a stencil making section 103, a printing section 104, a paper feed section 105, a sheet discharge section 106, and stencil disposal sections 107, 107 mounted at two locations.

The original read out section 102 is located above a body frame 108 and reads out an image pattern as input image data of an original to produce a train of electric signals. The read out information is processed to produce image data for ink of a first printing drum and for ink of a second printing drum.

The stencil making section 103 includes a stencil making unit 109 mounted in the body frame 108 for free horizontal movement. The stencil making-unit 109 is moveable with a stencil making unit transfer device 110 between a first stencil sheet feeder position to allow a first perforated stencil sheet 111 to a first printing drum 125 and a second stencil sheet feeder position to allow the stencil sheet 111 to a second printing drum 126. The stencil making-unit transfer device 110 is constructed having a stencil making-unit transfer motor 112, a worm gear 113 fixed to a rotary shaft of the stencil sheet making-unit transfer motor 112, a worm wheel (not shown) meshing with the worm gear 113, a pinion gear 114 connected to the worm wheel at an central axis thereof, and a rack 115 fixedly mounted to the body frame 108.

The stencil making unit 109 includes a stencil sheet roll container 116 which receives an elongated stencil sheet 111 formed in a rolled shape, a plurality of feed rollers 117 adapted to guide a leading edge of the stencil sheet 111 received in the stencil sheet roll container 116 toward a downstream side, a thermal printing head 118 located at a downstream side of the feed rollers 117, a platen roller 119 which is located in an opposed position of the thermal printing head 118 and which rotates with drive force exerted by a pulse motor (not shown), a stencil sheet feed roller 120 located at a downstream side relative to the platen roller 119 and the thermal printing head 118 and adapted to be driven with the drive force of the pulse motor, a guide plate 121 to which the stencil sheet feed roller 120 is held in pressured contact, and a stencil sheet cutter 122 located between a first area of the stencil sheet feed roller 120 and the guide plate 121 and a second area of the platen roller 119 and the thermal printing head 118.

The printing section 104 includes the first printing drum 125, the second printing drum 126, and a press drum 127, which serves as a rotary printing press member to impart printing pressure to the first and second printing drums 125 and 126, with the first and second printing drums 125 and 126 being located in right and left positions which are obliquely oriented relative to the center of the press drum 127. In particular, the first and second printing drums 125 and 126 are placed in close proximity to an outer circumferential periphery of the press drum 127 in the left and right positions angled at 90 degrees relative to a central axis of the press drum 127. The first and second printing drums 125 and 126 and the press drum 127 are rotatably mounted in the body frame 108, and are rotated with a printing drum rotating mechanism (not shown) at the same peripheral speeds in the vicinities of a first contact zone between the first printing drum 125 and the press drum 127 and a second contact zone between the second printing drum 126 and the press drum 127. The printing drum rotating mechanism is driven with a main motor (not shown) which serves as a drive source.

The first and second printing drums 125 and 126 have respective annular frame pairs (bearing no reference numerals) which are interconnected with stencil clamping bases 128, forming respective parts of outer circumferential peripheries of the first and second printing drums 125 and 126, respectively. The stencil clamping bases 128 have respective stencil clamping segments 129, by which leading edges of the stencil sheets 111 are clamped, respectively. Also, a leading edge of a screen 130 is fixed to each of the stencil clamping bases 128, with each screen 130 being wound on each of outer circumferential peripheries of the first and second printing drums 125 and 126.

A trailing edge portion of each screen 130 is stretched over each of the stencil clamping bases 128 by a spring 131, with each screen 130 being arranged to be expandable outward against the force of the spring 131. Each screen 130 is constructed of, for example, a mesh-shaped porous structure which, when it is pressed with an inner press roller 133, which will be discussed below, permits printing ink 138 to permeate from inward to outward. Thus, each screen 130 forms each outer circumferential periphery, which is supplied with printing ink 138, of each of the first and second printing drums 125 and 126.

Inside each of the screens 130 of the first and printing drums 125 and 126, an inner press mechanism 132 is accommodated. Each inner press mechanism 132 includes the inner press roller 133 which has a first function to exert a printing pressure to the screen 130 and a second function to supply the printing ink 138 to the screen 130.

Each of the inner press rollers 133 is rotatably supported by a pair of roller support members 134 located at both sides of each press roller and is rotated with a drive means, which is not shown, in synchronism with rotations of the first and second printing drums 125 and 126. The roller support members 134 are supported on a pivot shaft 135 for rotational movement thereabout such that, with rotation of the roller support members 134 in a direction as shown by an arrow a in FIG. 10, the roller support members 134 are moveable between an operative, press engagement position to cause the inner press roller 133 to press an inner periphery of the screen 130, and an inoperative, wait position when the roller support members 134 are rotated in a direction as shown by an arrow b. Each of the inner press rollers 33 assumes either the press engagement position during printing operation or the wait position during non-printing operation.

Further, each of the roller support members 134 carries first and second doctor rollers 136 and 137. The first and second doctor rollers 136 and 137 include cylindrical columns, respectively, and both are located in the vicinity of the inner press roller 133. Printing ink 138 is supplied from an ink supply unit (not shown) to a specified area in the vicinities of an outer circumferential space of the inner press roller 133 and an upper space surrounded between the first and second doctor rollers 136 and 137, with an ink pool 139 being formed in the specified area. The first printing drum 125 is supplied with printing ink 138 with a first color, and the second printing drum 126 is supplied with printing ink 138 with a second color.

A gap (an opposing distance) between the first doctor roller 136 and the inner press roller 133 is preset to a value sufficient for printing ink to be applied to the inner press roller 133 to form an ink film with a given thickness, and a gap between the second doctor roller 137 and the inner press roller 133 is preset to have a value suitable for printing ink to be prevented from being leaked. That is, as the inner press roller 133 rotates, printing ink with the given film thickness is continuously adhered to an outer circumferential surface of the inner press roller 133 owing to the gap between the first doctor roller 136 and the press roller 133, allowing the inner press roller 133 to supply printing ink onto the screen 130.

In addition, a print sheet clamp segment 140 is located at a given position of an outer circumferential periphery of the press drum 127, which serves as the rotary printing press member to impart a printing pressure to the printing drum, thereby clamping an edge of the print sheet 141 which is a print medium.

The paper feed section 105 is constructed as having a paper feed tray 142 on which print sheets 141, each serving as a print medium, are stacked, primary paper feed rollers 143, which is kept in press engagement with an uppermost print sheet 141 stacked on the paper feed tray 142, a secondary paper feed roller pair 144 located downstream of the primary paper feed rollers 143 and a guide plate pair 145 serving as a transfer guide for the print sheet between the secondary paper feed roller pair 144 and the press drum 127. Rotation of the paper feed rollers 143 causes only the uppermost print sheet 141 on the stack thereof to be transferred to the secondary paper feed roller pair 144, with the transferred print sheet 141 being fed to the printing section 104 in synchronism with the press drum 127 due to rotation of the paper feed roller pair 144.

The sheet discharge section 106 includes an upper limit guide segment 146 for guiding the leading edge of the print sheet 141 after it's printing step has been completed, a sheet separator claw 147 for separating the print sheet 141 from the press drum 127, a sheet discharge roller pair 148, which transfers the print sheet 141 guided by the upper limit guide 146 or the print sheet 141 separated with the sheet separator claw 147, and a paper receiving tray 149 which stacks the print sheets 141, discharged from the sheet discharge roller pair 148, in a stacked state.

The stencil disposal sections 107 are located in the body frame 108 in the vicinities of the first and second printing drums 125 and 126, respectively. Each of the stencil disposal sections 107 includes a pair of stencil discharge rollers 150 and 151, which are located in the vicinity of each of the first and second printing drums 125 and 126 in a slightly spaced relationship relative to each outer periphery, a stencil guide belt 152 which guides a leading edge of the stencil sheet 11 released from the stencil clamp segment 129, a stencil discharge roller 153 which transfers the stencil sheet 111, guided with the stencil guide belt 152, while separating it from each of the first printing drum 125 and the second printing drum 126 in conjunction with the stencil discharge roller 151, a stencil disposal box 154 for receiving the stencil sheet 111 transferred from the stencil discharge rollers 151 and 153, and a stencil compressing plate 155 for compressing the stencil sheets 111 toward a rearmost side of the stencil disposal box 154.

Figure 11:
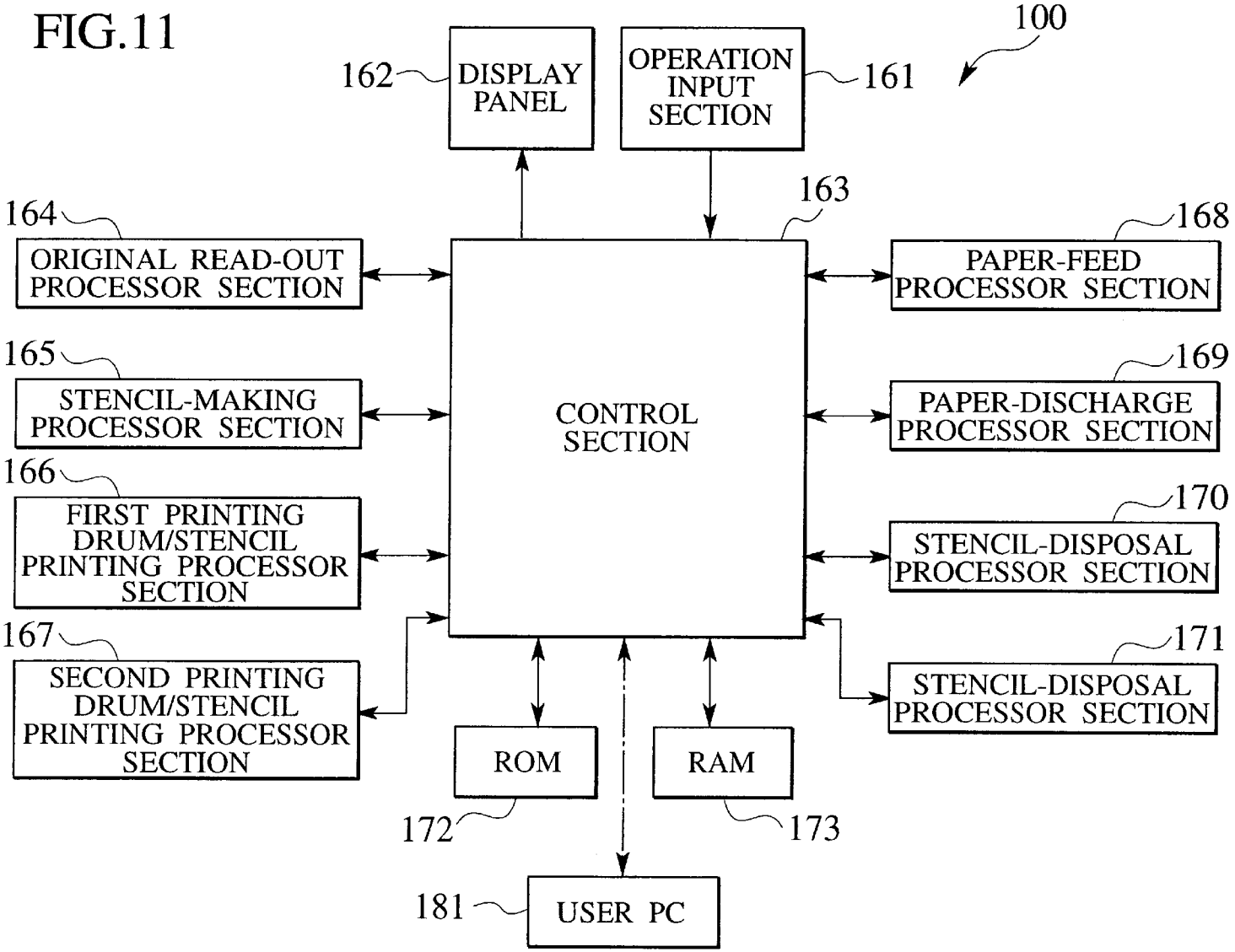
FIG. 11 is a block diagram for illustrating a structure of a stencil printing machine of a second preferred embodiment according to the present invention.

Now, a control system for controlling the operation of the stencil printing machine 100 is described below in detail with reference to FIG. 11. As shown in FIG. 11, the body frame of the stencil printing machine 100 of the second preferred embodiment of the present invention is provided with an operation input section 161 and a display panel 162. The operation input section 161 includes a stencil-making/printing start-up key, ten keys for inputting various input data such as the number of print sheets and a single-color printing key, which allow the user's operation to produce operation input information to be transmitted to a control section 163. The display panel 162 provides a display of various data transmitted from the control section 163.

Input data is outputted from the operation input section 161 to the control section 163, which responds to the input data and executes general control over an original read-out processor section 164, a stencil-making processor section (stencil making section) 165, first and second stencil-printing processor sections (printing sections) 166 and 167, a paper-feed processor section 168, a sheet discharge processor section 169, and stencil-disposal processor sections 170 and 171, which are located at two different positions. Also, the control section 163 executes control for writing-in or reading-out from a ROM 172, in which various control programs are stored, and a RAM 173.

Further, the control section 163 is interconnected with a personal computer 181 (which is hereinafter called as a user PC 181) via a communication network such that it is enabled to read in image data and printer control commands from the user PC 181.

The control section 163 responds to printer control commands, which are produced by a printer driver installed in the user PC 181, for executing operational control, such as input of image data, start-up and stop control of stencil making operation, and start-up and stop control of printing operation.

As executed by the CPU in the first preferred embodiment, the CPU in the second preferred embodiment responds to a user's command to perform the printing operation When implementing the printing operation with the stencil printing machine 100 responsive to the user's command, like the CPU of the first preferred embodiment discussed above, the CPU of the second preferred embodiment transmits scheduled printing order information representative of a scheduled order of the printing process, as well as image data, to the stencil printing machine 100.

When executing a printing operation to reproduce image data, shown in FIG. 3, in the order of particular pages, the CPU produces scheduled printing order information to execute the printing operation in a programmed order as indicated by a printing order table 190 shown in FIG. 12. In an example of the printing order table 190 shown in FIG. 12, there is shown a scheduled printing order for the printing process to be implemented, with the use of the printing drums with ink in black, blue and red colors, over a first page to a fourth page, with the scheduled printing order bearing numerals (hereinafter referred to as "enclosed numerals") enclosed with circles and the first and second printing drums bearing non-enclosed numerals added to the enclosed numerals. That is, in FIG. 12, a symbol "①-1" represents that a first printing step is performed using the first printing drum 125.

Now, a technology for producing printing sequence information without using ink color information is described below in detail with reference to FIG. 12. According to the printing order table 190 shown in FIG. 12, the first printing operation is executed over the first page using the first printing drum 125 with ink in a black color, followed with the second printing drum 126 with ink in blue color. In a second printing operation, similarly, the printing of the second page is carried out using the first printing drum 125 with ink in black color and the second printing drum 126 with ink in blue color. Subsequently, in a third printing operation, the printing of a third page is performed using the first printing drum with ink in black color and the second printing drum 126 whose printing ink is replaced with ink in red color from the ink in blue color. In a fourth printing operation, the printing of a fourth page is performed using the first printing drum with ink in black color and the second printing drum 126 whose printing ink is replaced with ink in blue color from the ink in red color. In a fifth printing operation, the printing of the third page is implemented using only the second printing drum whose printing ink is replaced with ink in red color from the ink in blue color. In this case, the order of the pages to be printed is not fixed requiring the replacement of the printing drums in three times.

Figure 13:
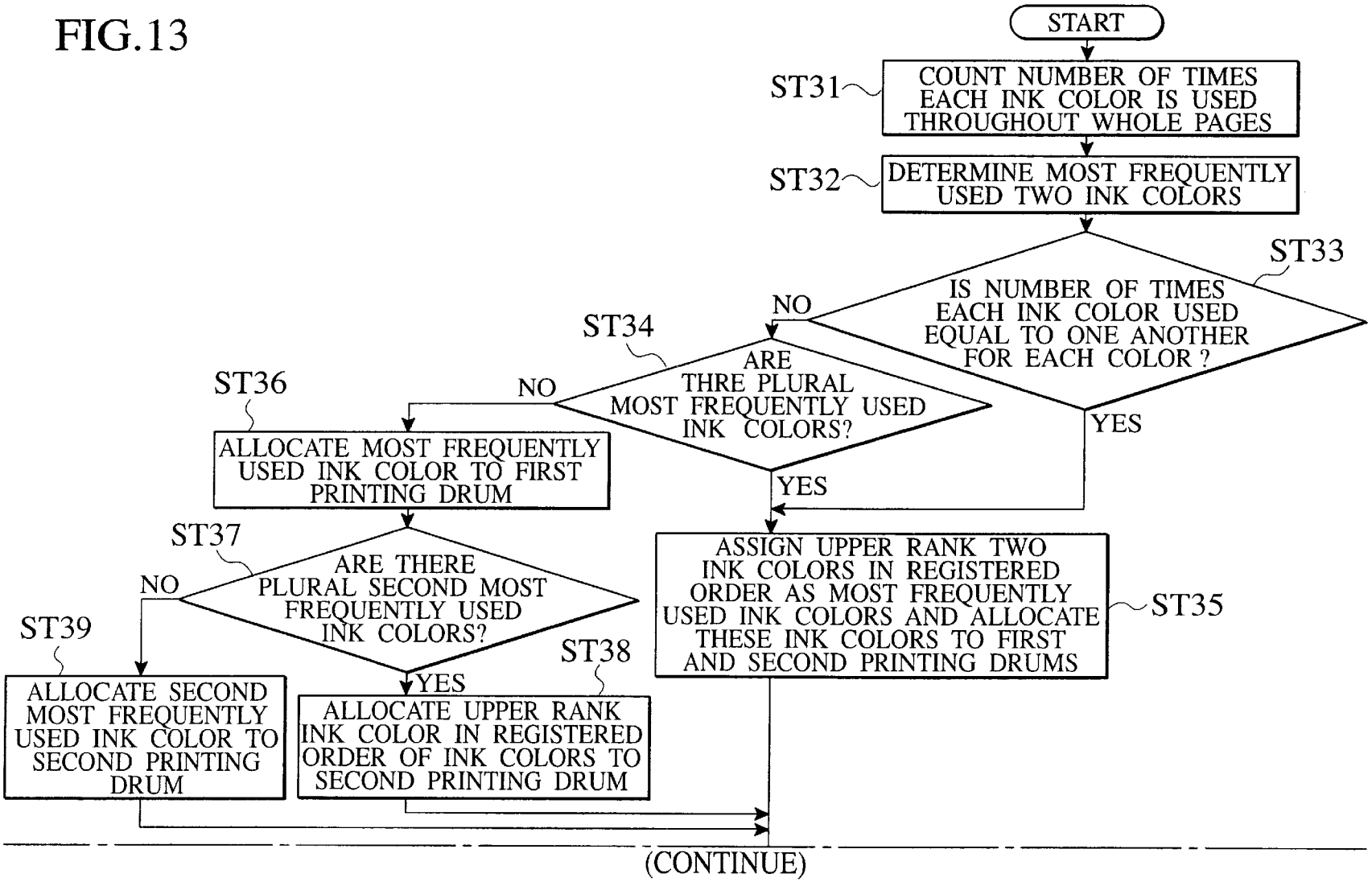
FIG. 13 is a view for illustrating a printing order table representative of printing order information to be produced in the CPU when executing the printing operation by reducing the number of times the printing drum while keeping the page order is replaced in the stencil printing machine, in the second preferred embodiment.

Now, the basic sequence for the CPU to process for producing scheduled printing order information representative of the order of the pages, contained in image data, for which the printing process is to be implemented is described below in detail in conjunction with FIG. 13.

First, the CPU produces image data representative of an image object to be printed, and upon receiving the user's command for printing according to the order of the pages, in step ST31, the CPU begins to count the number of times each ink color is used throughout whole pages contained in image data.

In step ST32, the CPU determines most frequently used two ink colors and, in the next step ST33, the CPU discriminates whether the number of printing times associated with each ink color, counted in step ST31, is equal to one another or is different from one another. When discriminating that the number of printing times associated with each ink color is equal to one another, the operation goes to step ST35 whereas if not, the operation goes to step ST34.

In step ST34, the CPU discriminates whether there are a plurality of most frequently used ink colors among the respective ink colors counted in step ST31. When discriminating that there are most frequently used ink colors, the operation goes to step ST35 and, if not, the operation goes to step ST36.

In step ST35, the CPU processes to allocate the higher rank ink colors, which remain in the registered order, to the first and second printing drums 125 and 126, and the operation goes to step ST40.

In step ST36, the CPU allocates the most frequently used ink color to the first printing drum 125 and, in the next step ST37, the CPU discriminates whether there are plural more frequently used ink colors. When it is discriminated that there are plural more frequently used ink colors, the operation goes to step ST38 and, if not, the operation goes to step ST39.

In step ST38, the CPU allocates a particular ink color, which is selected from the higher rank ink colors which remain in the registered order, to the second printing drum 126, and the operation goes to step ST40.

In step ST39, the CPU allocates the second most frequently used ink color to the second printing drum 126, and the operation goes to step ST40.

In step ST40, the CPU leads the operation to determine for allocating the other ink color, which remains non-allocated to the printing drum in the aforementioned processing steps, to the printing drum to be used within the page to be printed.

In the next step ST41, the CPU discriminates whether there are more frequently used ink colors within the page. When the absence of the more frequently used ink colors within the page is discriminated, the operation goes to step ST42, and if the CPU finds it to be YES, the operation then goes to step ST43.

In step ST42, the CPU allocates the ink colors to the respective printing drums in the registered order, and in step ST46, the CPU produces scheduled printing order information to enable printing on the interrelated pages according to the page order.

In step ST43, the CPU discriminates whether there is one color present in the more frequently used ink colors. When it is discriminated that there is the one color present in the more frequently used ink colors, the operation then goes to step ST44, and if not, the operation goes to step ST45.

In step ST44, the CPU combines the higher rank ink color remaining in the registered order with the more frequently used ink color and allocates such an ink color combination to either one of non-allocated printing drums. Subsequently, the remaining ink colors are allocated to respective printing drums according to the registered order. In the next step ST46, the CPU produces scheduled printing order information to enable printing for the associated pages according to the page order.

In step ST45, the CPU allocates the more frequently used, two ink colors to the particular printing drums in accordance with determination, with the remaining more frequently used ink colors being assigned to respective printing drums according to the registered order. In the next step ST46, the CPU produces scheduled printing order information to enable printing for the associated pages according to the page order.

When printing image data onto a print sheet according to the page order as seen in FIG. 3, the CPU produces scheduled printing order information to enable printing in a sequence as represented by a printing sequence table 192 shown in FIG. 14.

According to the printing order table 192 shown in FIG. 14, in a first printing step, a first page is printed using the first printing drum 125 with black ink color and the second printing drum 126 with blue ink color. In the next, second printing step, the second page is similarly printed using the first printing drum 125 with the black ink color and the second printing drum 126 with the blue ink color. In a third printing step, the third page is printed using only the second printing drum 126 under a condition wherein the blue ink color is replaced with the red ink color. In a fourth printing step, the third page is printed using the first printing drum 125 with the black ink color and the printing drum 126 with the red ink color. In a fifth printing step, a fourth page is printed using the first printing drum 125 with black ink color and with the second printing drum 126 wherein the red ink color is replaced with the blue ink color. It will thus be seen that even when executing the printing operation on the basis of image data shown in FIG. 3, the CPU enables the printing operation in the page order while limiting the number of times the printing drum is replaced to two times.

Figure 15:
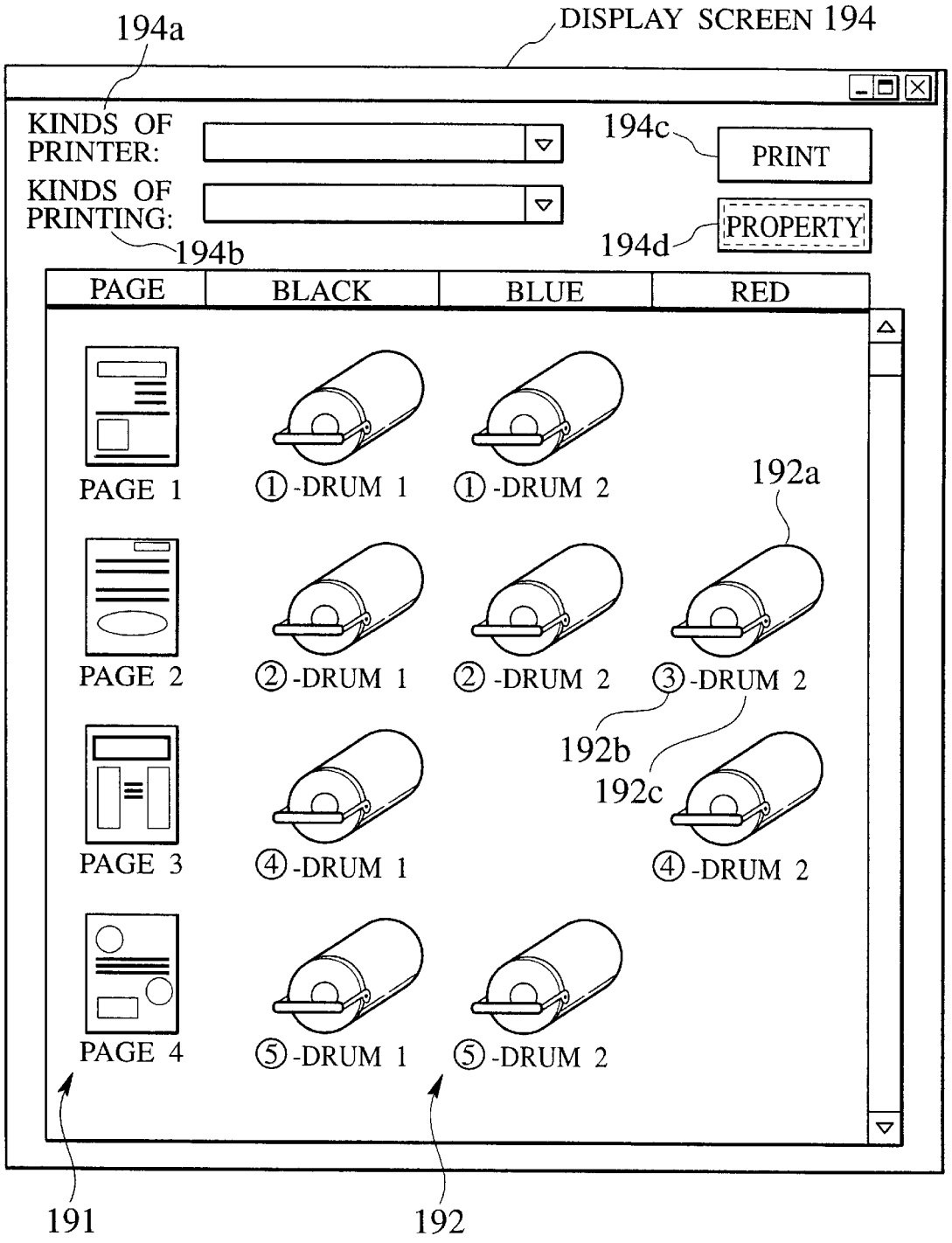
FIG. 15 is a view for illustrating a display screen of a display monitor of a user PC for displaying a page summary display and an ink drum display in accordance with printing order information in the second preferred embodiment.

During execution of the process discussed above, the CPU allows a display screen 194 as shown in FIG. 15 to appear on the display monitor of the user PC 181. According to the display screen 194 shown in FIG. 15, the display screen 194 has in an upper part a selection column 194*a* for selecting kinds of printer, a selection column 194*b* for selecting kinds of printing, a print key button 194*c* and a property button 194*d*. As shown in FIG. 15, the CPU allows a page summary display 191, which represents a page summary, and an ink drum display 192, which represents ink drums to be used for associated pages, to appear over the display monitor.

The ink drum display 192 involves a plurality of picture pattern displays 192*a* representing the first printing drum 125 and the second printing drum 126 added with respective ink colors to be used in correlated relationship with the page summary display 191 contained in image data, sequence order displays 192*b* each for displaying a sequence order in which the printing operation is executed with the first printing drum 125 or the second printing drum 126, and using printing drum displays 192*c* each representing the using printing drum.

Like in the first preferred embodiment, the CPU responds to a signal, indicative of termination of the printing operation with the first and second printing drums 125, 126, outputted from the stencil printing machine 100, thereby allowing a printing termination display given with check marks to appear in the display screen 194, while allowing the presence of need for either the first printing drum 125 or the second printing drum 126 to be replaced to appear on the display screen 194 to instruct the user.

Further, the CPU produces display data, to display the contents of the printing sequence over the display screen 194, on the basis of printing sequence information, with resultant display data being transmitted to the stencil printing machine 100. Responding to such display data, the control section 163 of the stencil printing machine 100 allows the display panel 162 to display the contents of a printing schedule table 196 as viewed in FIG. 16.

As seen in FIG. 16, the display monitor 162 displays the printing schedule table 196, which involves a file's title display 201 for displaying the title assigned to image data, an owner's name display 202 for displaying the user's name who operates the user PC 181, a printing order display 203 representative of a printing order for each page, a page summary display 204 for displaying a page summary associated with the printing order display 203, a page display 205 for displaying a page number and the contents of each page, a first drum display 206 displaying whether to execute the printing operation with the first printing drum 125 in dependence on the printing order display 203 while displaying the ink color to be used for the first printing drum 125, and a second drum display 207 displaying whether to execute the printing operation with the second printing drum 126 in dependence on the printing order display 203 while displaying the ink color to be used for the second printing drum 126.

With such a printing schedule table 196, it is possible for the stencil printing machine 100 to instruct the user, who is in charge of exchanging the ink colors for the first printing drum 125 and the second printing drum 126, about various information such as the printing execution order, and the timings at which the first and second printing drums 125, 126 are to be replaced.

Figure 17:
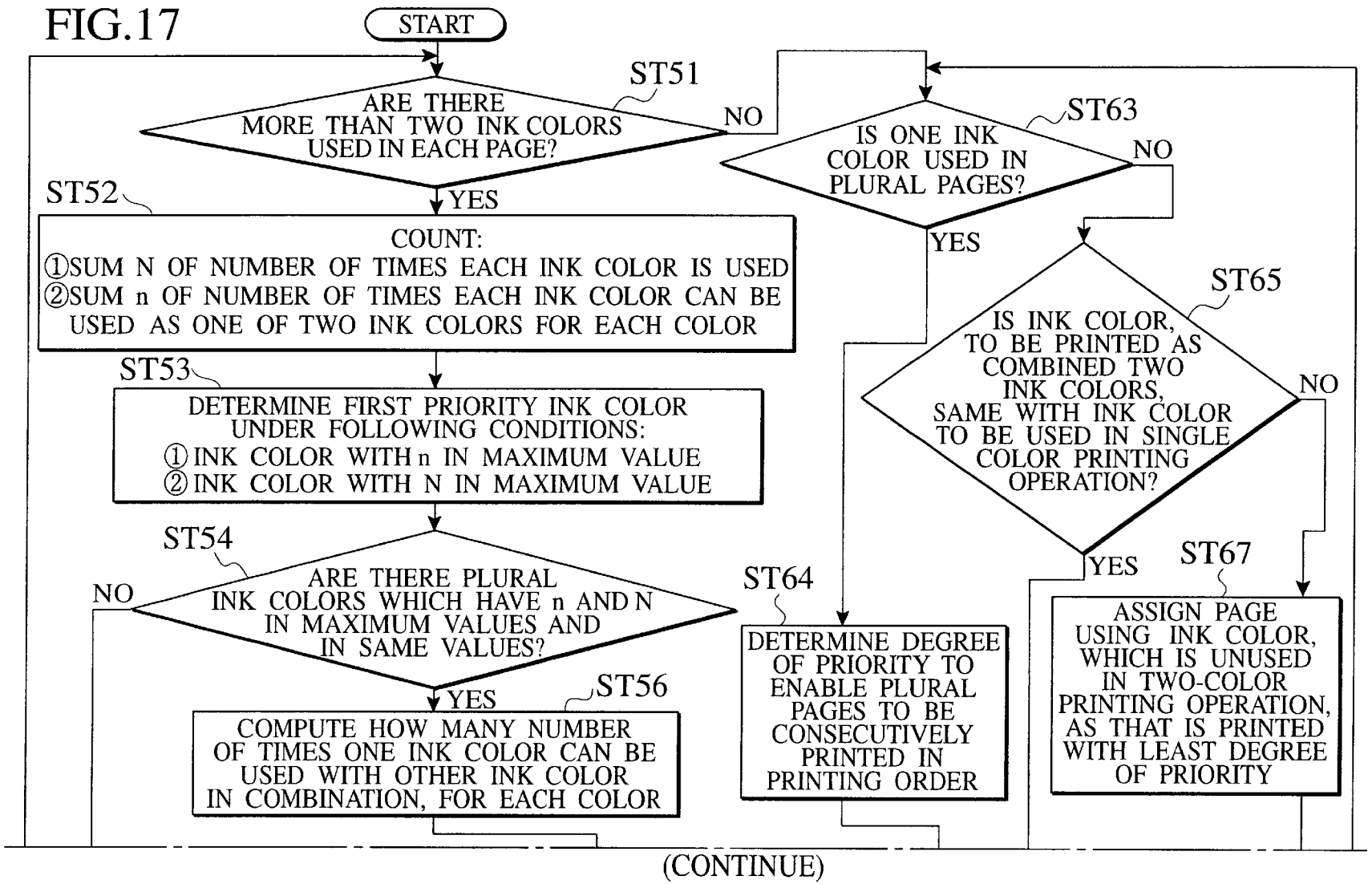
FIG. 17 is a general flow diagram for illustrating the basic sequence of a process to be carried out in the CPU when producing printing order information so as to reduce the number of times the printing drum is replaced, in the second preferred embodiment.

Now, the basic sequence of a process to be carried out in the CPU for producing printing sequence information in order to reduce the number of times the printing drums is replaced is described below in detail with respect to FIG. 17.

First, the CPU produces image data which becomes an object to be reproduced and upon receiving the print command initiated by the user's operation so as to reduce the number of times the printing drums are to be replaced, discriminates, in step ST51, whether more than two ink colors are used for each page contained in image data or not. When it is discriminated that more than two ink colors are used in each page, the operation goes to step ST52 and if not, the operation goes to step ST63 which will be described later.

In the next step ST52, the CPU counts the sum N of the number of times each of the ink colors is used, and the sum n of the number of times the printing is performed with combined two ink colors for each ink color, throughout the whole pages. That is, the CPU counts the sum n and the sum N in order to know about what is the maximum number of times the printing operation can be consecutively executed without causing replacement of the first and second printing drums 125, 126.

In the next step ST53, the CPU responds to the counted results achieved in step ST52 to obtain a particular ink color having the maximum value in the aforementioned sum n and another particular ink color having the maximum value in the aforementioned sum N, thereby determining the ink color to be used with first priority.

In the next step ST54, the CPU discriminates whether there are plural ink colors having the maximum values in the sum n and the sum N or not. When it is discriminated that there are no plural ink colors having the maximum values in the sum n and the sum N with the same number of usage times, the operation goes to step ST55. When the presence of the associated plural ink colors is discriminated, the operation goes to step ST56.

In step ST55, the CPU determines the ink color, which has the maximum values in the sum n and the sum N, as a first priority ink color and counts the number of times the ink color is used for printing in combination with the first priority ink color which has been determined to obtain the ink color having the maximum value, rendering the operation to go to step ST58.

In step ST56, the CPU counts the number of times the printing operation is performed with the other ink color for each ink color. In step ST57, the CPU determines the particular ink color and the other ink color, having the maximum value in the number of times the printing operation is executed, as the first priority ink colors.

In the next step ST58, the CPU determines the ink color, to be used as two ink color pair, which is used for printing together with the first priority ink color determined in step ST55 or in step ST57. After such determination, the CPU register two-color printing information representative of a combination of the ink colors to be used for a two-color printing operation with concurrent use of the first printing drum 125 and the second printing drum 126.

In the next step ST59, the CPU processes to delete the combinations of the ink colors determined in step ST56 for each page contained in image data. That is, the CPU determines to execute the printing operation over the page associated with the ink colors incorporated in the particular combination determined in step ST58.

In the next step ST60, the CPU discriminates whether determination of the two-ink color pair, for executing the printing operation concurrently using the first printing drum 125 and the second printing drum 126, has been terminated or not. Upon terminating the determination process for the two-ink color pair to be used for the printing operation, the operation goes to step ST61 and when determination process is not completed, the operation returns to step ST51 to step ST59 for repeated processing purposes.

In step ST63 wherein the absence of usage of more than two ink colors for each page in step ST51 is discriminated, the CPU discriminates whether the single ink color is used for plural pages. When discriminating that the single ink colors are used for the plural pages, the operation goes to step ST64 and if not, the operation goes to step ST65.

In step ST64, the CPU detects particular plural pages for which the printing operation is consecutively performed according to the printing order, then going to step ST61.

In step ST65, the CPU discriminates whether to use the ink colors, which have been registered in the two-color printing information determined in step ST58, in the single color printing operation. When the CPU discriminates that the ink colors, which have been registered in the two-color printing operation, are used for executing the single color printing operation, the operation goes to step ST66 and when the discrimination is made not to use the registered ink colors for the single color printing, the operation goes to step ST67.

In step ST66, the CPU determines whether the single color operation is performed subsequent to or prior to the two-color printing operation on the basis of the page order which is intended for executing the single color printing operation, thereby going to step ST61.

In step ST67, the CPU assigns the page, which uses the ink color unused in the two-color printing operation in step ST65, as that is to be printed with the least priority, thereby going to step ST61.

In step ST61, the CPU discriminates whether the process steps have been completed in the aforementioned step ST63 to step ST67 throughout the whole pages to be printed in the single color printing operation. When it is discriminated that the process in steps ST63 to step ST67 for the whole pages to be printed in the single color printing operation, the operation goes to step ST62, and if not, the operation returns to step ST63 to prosecute the processes subsequent to step ST63.

In step ST62, the CPU determines printing order information according to the degree of priority with respect to the two-color printing operation obtained in step ST58 and the single color printing operation obtained in step ST64, step ST66 and step ST67. That is, taking into account the degree of the first priority given to the two-color printing operation to be maximum, the CPU produces information representative of the single color printing operation having the same ink color as that used in the two-color printing operation, information representative of the single color printing operation having the ink color used in the plural pages, and printing order information on the basis of information representative of the single color printing operation having the ink color to be singularly used.

As such, according to the printing order table 198 shown in FIG. 18, first to third printing processes are implemented to print on the first page, the second page and the fourth page using the first printing drum 125 with black color and the second printing drum 126 with the blue ink color. Subsequently, in the fourth printing process, the third page is printed, using the first printing drum 125 and the second printing drum 126 wherein the blue color is replaced with the red ink color. Next, in a fifth printing process, the second page is printed using only the second printing drum 126 with the red ink color. Thus, even when executing the printing operation on the basis of image data shown in FIG. 3, the CPU makes it possible for the stencil printing machine to perform the printing operation with only one time the printing drum is replaced.

Having explained the example wherein the stencil printing machine is supplied with image data and printing order information, representative of the printing order to be employed in the printing operation with the use of image data, which are transmitted from the user PC 71, it may be possible for the user to produce printing order information with the control section 53 by referring to the display panel. In this instance, also, the control section 63 implements control so as to display the display screen, as shown in FIG. 15, over the display panel of the stencil printing machine 50. With such stencil printing machine 50, it is possible to obtain the same results as those obtained in the aforementioned example.

While, in the second preferred embodiment, description is made in conjunction with the case wherein the stencil printing machine 100 operates to control the printing order in response to print command, to execute the printing operation according to the page order, or print command, to enable the printing operation so as to reduce the number of times the first printing drum 125 and the second printing drum 126 are replaced with, transmitted from the user PC 181, based on other conditions, namely, in order to give the first priority to the image quality by minimizing the number of re-transfer of image, it may be possible to produce print order information representative of the order in which the printing operation is commenced by suing the first printing drum 125 and the second printing drum 126 with the ink colors in lower ink color concentration.

While, in the aforementioned example, a description is made with respect to the case wherein, when executing the printing operation, the CPU produces scheduled printing order information based on the page order and print order information to reduce the number of times the first printing drum 125 and the second printing drum 126 are replaced with, the CPU may produce scheduled printing order information taking into account the plural conditions. That is, for example, the CPU may produce printing order information on the basis of the page order while minimizing the number of re-transfer of image.

While, in the aforementioned example, a description is made with respect to the case wherein the user PC 181 is responsive to print command to automatically produce scheduled printing order information, in accordance with the ink color contained in image data, in the automatic sequence mode, the user PC 181 may produce scheduled printing order information in dependence on the user's operation input for controlling the stencil printing machine 100, or may take the manual mode responsive to user's operation input to update scheduled printing order information which has been automatically produced. Also, it may be possible for the user to operate the user PC 181 to select either one of the automatic mode or the manual mode with the user's operation input.

While, in the second preferred embodiment discussed above, the stencil printing machine 100 has been shown and described as having two printing drums, the present invention is not limited thereto and may be modified so as to have other number of the printing drums to obtain the same results and advantages as those explained above.

What is claimed is:

1. A printing control apparatus for controlling a stencil printing machine wherein a stencil sheet formed on the basis of printing data is wound around a replaceable printing drum with which a print sheet is held in pressured contact to implement a stencil printing operation, said printing control apparatus comprising:

a read out section which obtain color image data from a plurality of sequential original pages, each original page having an image thereon in at least one color;

an information producing section configured to produce printing order information on the basis of color image data from said read out section and corresponding image ink color information for each page contained in image data representative of an image to be reproduced in said stencil printing operation, in dependence on a page order, in which said stencil printing operation is executed, and based on the number of times said printing drum is replaced; and with an outputting section configured to output said image data and said printing order information to said stencil printing machine.

2. The printing control apparatus according to claim 1, wherein:

said information producing section has at least one of an automatic order mode in which said printing order information is produced by automatically determining a printing order, and a manual order mode in which said printing order information is produced according to a user's command.

3. The printing control apparatus according to claim 1, wherein: said stencil printing machine includes a single cartridge type printing drum; and wherein:

said information producing section produces printing order information on the basis of an ink color of said single cartridge type printing drum.

4. The printing control apparatus according to claim 3, wherein:

said information producing section discriminates on the basis of image data whether there is an ink color to be used in plural pages whose page numbers are consecutive for producing printing order information representative of a printing order which covers said plural pages and for producing printing order information representative of said printing order within a page according to an order of said ink colors which are preliminarily registered.

5. The printing control apparatus according to claim 3, wherein:

said information producing section enables said printing operation over whole pages according to page numbers for each ink color which is preliminarily registered.

6. The printing control apparatus according to claim 3, wherein:

said information producing section counts the number of times each ink color is used throughout whole pages contained in image data such that when the numbers of usage times for each ink color is equal to one another, said printing order producing section produces printing order information to enable said printing operation according to a page number.

7. The printing control apparatus according to claim 1, wherein:

said stencil printing machine includes a plurality of cartridge type printing drums with ink colors different from one another; and wherein:

said information producing section produces printing order information on the basis of ink colors of said respective cartridge type printing drums.

8. The printing control apparatus according to claim 7, wherein:

said information producing section counts the number of times each ink color is used throughout whole pages contained in image data and produces printing order information to enable the printing operation by allocating a most frequently used ink color to either one of said printing drums to be used.

9. The printing control apparatus according to claim 7, wherein:

said information producing section produces printing order information to initially execute a multi-color printing operation using said plurality of printing drum and t subsequently execute a single-color printing operation using single printing drum.

10. The printing control apparatus according to claim 7, wherein:

said information producing section produces printing order information to enable said printing operation with a single ink color on the basis of a degree of priority representative of whether when producing printing order information to achieve said printing operation with the single ink color, said same ink color is used over plural pages in which page numbers are consecutive, and a degree of priority representative of whether said ink color is used in said multi-color printing operation.

11. The printing control apparatus according to claim 1, wherein:

said information producing section produces printing order information according to said page order for each page contained in image data.

12. The printing control apparatus according to claim 1, wherein:

said information producing section produces printing order information representative of a printing order to reduce the number of times said printing drums are replaced with for said different ink colors.

13. The printing control apparatus according to claim 1, wherein:

said information producing section produces printing order information representative of a printing order to give a first priority to an image quality.

14. The printing control apparatus according to claim 1, further comprising:

a display data producing section configured to produce display data for displaying a page display representative of a summary of each page on the basis of image data, a printing drum display representative of said printing drums, to be displayed for each page, with respective ink colors to be used for printing each page, and an order display representative of a printing order using said printing drums displayed in said printing drum display.

15. The printing control apparatus according to claim 14, wherein:

said display data producing section produces display data representative of whether to use either one of the printing drums as the printing drum display.

16. The printing control apparatus according to claim 14, wherein:

said display data producing section produces display data representative of whether to execute the printing operation with either one of said printing drums and to display respective ink colors of said printing drums, in dependence on said printing order display representative of said printing order for each page, said page display for displaying said page number and contents of each page depending on said printing order display, and said printing order display.

17. A computer-readable record medium having stored thereon a program for controlling a stencil printing machine wherein a stencil sheet is formed on the basis of image data and wound on an replaceable printing drum with which a print sheet is held in pressured contact to perform a stencil printing operation, said computer-readable record medium comprising:

a read out section which contains color image data obtained from a plurality of sequential original pages, each original page having an image thereon in at least one color;

an information producing section configured to produce printing order information on the basis of color image data from said read out section and corresponding image ink color information for each page contained in image data representative of an image to be reproduced in said stencil printing operation, in dependence on a page order, in which said stencil printing operation is executed, and based on the number of times said printing drum is replaced; and with an outputting section configured to output said image data and said printing order information to said stencil printing machine.

18. The computer-readable record medium according to claim 17, wherein:

said information producing section has at least one of an automatic order mode in which said printing order information is produced by automatically determining a printing order, and a manual order mode in which said printing order information is produced according to a user's command.

19. A program product for controlling a stencil printing machine, having a plurality of exchangeable printing drums, wherein respective printing drums are mounted with respective stencil sheets which are formed on the basis of image data with which a print sheet is held in pressured contact to perform a stencil printing operation, said program product comprising:

a read out section which obtains color image data from a plurality of sequential original pages, each original page having an image thereon in at least one color;

an information producing section configured to produce printing order information on the basis of color image data from said read out section and corresponding image ink color information for each page contained in image data representative of an image to be reproduced in said stencil printing operation, in dependence on a page order, in which said stencil printing operation is executed, and based on the number of times said printing drum is replaced; and with an outputting section configured to output said image data and said printing order information to said stencil printing machine.

20. A program product according to claim 19, wherein:

said information producing section has at least one of an automatic order mode in which said printing order information is produced by automatically determining a printing order, and a manual order mode in which said printing order information is produced according-to a user's command.

21. A printing system comprising:

a stencil printing machine wherein a stencil sheet is formed on the basis of image data and wound on a replaceable printing drum with which a print sheet is held in pressured contact to perform a stencil printing process; and a read out section which obtains color image data from a plurality of sequential original pages, each original page having an image thereon in at least one color;

a printing control apparatus including an information producing section configured to produce printing order information on the basis of color image data from said read out section and corresponding image ink color information for each page contained in image data representative of an image to be reproduced in the stencil printing operation, in dependence on a page order, in which said stencil printing operation is executed, and based on the number of times said printing drum is replaced, and with an outputting section configured to output said image data and the printing order information to said stencil printing machine.

22. A printing system according to claim 21, wherein:

said information producing section has at least one of an automatic order mode in which said printing order information is produced by automatically determining a printing order, and a manual order mode in which said printing order information is produced according to a user's command.

* * * * *

UNITED STATES PATENT AND TRADEMARK OFFICE

CERTIFICATE OF CORRECTION

PATENT NO. : 6,662,717 B2
DATED : December 16, 2003
INVENTOR(S) : Kubota et al.

It is certified that error appears in the above-identified patent and that said Letters Patent is hereby corrected as shown below:

Column 22,
Line 34, change “t” to -- to --.
Line 35, change “using single” to -- using a single --.

Column 24,
Line 25, change “according-to” to -- according to --.

Signed and Sealed this

Third Day of February, 2004

JON W. DUDAS
*Acting Director of the United States Patent and Trademark Office*